US008036560B2

(12) United States Patent
Otsuka

(10) Patent No.: US 8,036,560 B2
(45) Date of Patent: Oct. 11, 2011

(54) IMAGE FORMATION APPARATUS AND IMAGE FORMATION METHOD

(75) Inventor: Yutaka Otsuka, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 349 days.

(21) Appl. No.: 12/408,445

(22) Filed: Mar. 20, 2009

(65) Prior Publication Data

US 2009/0317117 A1 Dec. 24, 2009

(30) Foreign Application Priority Data

Jun. 19, 2008 (JP) ..... 2008-159998

(51) Int. Cl.
*G03G 15/20* (2006.01)

(52) U.S. Cl. ..... 399/70; 219/216

(58) Field of Classification Search ..... 399/70, 399/69; 219/216
See application file for complete search history.

(56) References Cited

U.S. PATENT DOCUMENTS

| | | | | |
|---|---|---|---|---|
| 6,185,388 | B1 | 2/2001 | Yamamoto | |
| 2003/0235423 | A1 | 12/2003 | Ota | |
| 2005/0095026 | A1 | 5/2005 | Ota | |
| 2006/0013607 | A1* | 1/2006 | Yoshikawa | 399/69 |
| 2009/0310998 | A1* | 12/2009 | Otsuka | 399/70 |

FOREIGN PATENT DOCUMENTS

| | | |
|---|---|---|
| JP | 62-206581 | 9/1987 |
| JP | 06-202526 | 7/1994 |
| JP | 11-249489 | 9/1999 |
| JP | 2002-23554 | 1/2002 |
| JP | 2004-21211 | 1/2004 |
| JP | 2006-133471 | 5/2006 |

OTHER PUBLICATIONS

Japanese Office Action mailed May 11, 2010, directed to counterpart Japanese Application No. 2008-159998; 3 pages.

* cited by examiner

*Primary Examiner* — Sophia S Chen
(74) *Attorney, Agent, or Firm* — Morrison & Foerster LLP

(57) ABSTRACT

A standby state is where a pair of rotating bodies stops rotating, and temperature control is performed so that a rotating body reaches a standby temperature. A fixing state is where the rotating bodies are rotating and temperature control is performed so that a rotating body reaches a fixing temperature that changes in accordance with a setting. An image formation apparatus includes a judgment part for judging whether to transition from the fixing state to the standby state, and a fixing controller for, upon a judgment by the judgment part to transition to the standby state, prior to performing temperature control to reach the standby temperature, causing the pair of rotating bodies to rotate, and performing temperature control so that the temperature of a rotating body reaches a predetermined transition temperature range including temperatures higher than a lowest fixing temperature setting, and lower than a highest fixing temperature setting.

20 Claims, 12 Drawing Sheets

IMAGE FORMATION APPARATUS AND IMAGE FORMATION METHOD

This application is based on application No. 2008-159998 filed in Japan, the content of which is hereby incorporated by reference.

BACKGROUND OF THE INVENTION

1. Field of the Invention

The present invention relates to an image formation apparatus including a fixing device, and in particular to technology for appropriately controlling a temperature of rotating bodies such as fixing rollers and pressure application rollers in the fixing device, in a case of, in a standby state, stopping the rotating bodies and regulating the temperature thereof to reach a predetermined standby temperature.

2. Description of Related Art

In general, in image formation apparatuses including fixing devices that use a heat roller fixing method, stopping rotation of rotating bodies in the fixing device when in a standby state enables suppressing deterioration of the rotating bodies and peripheral parts, reducing noise, and realizing an energy-conserving effect to some degree.

Here, for example, a substantial energy conservation effect can be anticipated when a thermal power is turned completely OFF when in a standby state. However, when the time to form the image arrives, it is necessary to wait for the temperature to rise to a sufficient temperature for fixing. Since this prolongs the time waiting for printing to start, this method has remarkably poor usability, and so is not preferable.

In view of this, to enable printing to start quickly, a method is used of a standby state in which, though the rotation of the rotating bodies is stopped, the thermal power is not completely turned off, and the temperature is regulated to a predetermined standby temperature.

Meanwhile, since the heat conductivity sharply decreases when the rotation of the rotating bodies is stopped, there is a tendency for the temperature of the rotating bodies to rise even when the thermal power has been turned OFF, likely due to factors such as a temperature gradient influence becoming noticeable. In a case that the temperature at the time that fixing ends is near an upper end, a problem arises that if rotation of the rotating bodies is stopped soon after the fixing ends, the temperature of the rotating bodes rises too high, leading to deterioration of the rotating bodies and peripheral parts.

In view of this, as conventional technology for solving the problem described above, Japanese Patent Application Publication No. H06-202526 (document 1) discloses an image formation apparatus that detects a temperature of a heater, waits for the temperature of the heater to be less than or equal to a predetermined temperature, and causes a roller pair (a pair of rotating bodies) to stop (claim 1, etc.). Also, Japanese Patent Application Publication No. H11-249489 (document 2) discloses an image formation apparatus that, immediately after a last recording material (recording sheet) has passed through a fixing nip, turns a heater OFF, stops the rotation of a rotating body pair (a pair of rotating bodies) after a predetermined time period, and after a further predetermined time period has passed, restarts temperature control (claim 4, etc.).

Document 1 recites detecting the temperature of the heater. As can be seen in an example of using a halogen heater as the heater, since this type of heater has an attribute such that the temperature thereof rises quickly when turned ON and falls comparatively quickly when turned OFF, lowering the temperature of the roller pair is nearly impossible even when the temperature of the heater is detected and control is performed. Therefore, achieving the described advantageous effect with use of this type of structure is considered impossible. Also, even considering a case of detecting the temperature of the roller pair instead of detecting the temperature of the heater in document 1, the method described is merely to always wait for the temperature to reach a temperature that is lower than the temperature at the time of the end of fixing, and to stop the rotation of the roller pair. This method may succeed when the fixing temperature is always a high temperature and is a fixed value. However, when the fixing temperature is a low temperature, the temperature falls too low. If a printing instruction is received at such a time, the waiting time until printing starts is prolonged and fixing faults are likely to occur, so this method is not preferable. There is a range in actual fixing temperatures from approximately 140° C. to 200° C., for example, depending on conditions including settings such as type of recording sheet and degree of glossiness, environmental temperature etc., and such actual circumstances have not been given any consideration in document 1.

Also, in document 2, the method described is to always switch the heater off and cause the rotating bodies to rotate, then stop the rotation and further maintain that state for a predetermined period of time. Therefore, similarly to the case of document 1, if the fixing temperature is a low temperature, the temperature falls too low, and if a printing instruction is received at such a time, the waiting time until printing starts is prolonged and fixing faults are likely to occur. In addition, another problem arises, namely that fixing is forcibly stopped when an abnormally low temperature error is erroneously detected.

Furthermore, since the temperature of the above-described rotating bodies is comparatively slow to rise, and quickly falls to some degree by passing the paper through the fixing nip, it is desirable to set a regulated temperature in the standby state near a higher end of fixing temperatures that are anticipated. However, in a case that a transition from a low temperature to the standby temperature is always made when the rotation of the rotating bodies have stopped, such as in document 1 and document 2, if the temperature setting in standby is a high temperature, there tends to be a large overshoot due to applying heat to the rotating bodies for a long period of time. Accordingly, a new problem arises that the temperature of the rotating bodies becomes too high, leading to deterioration of the rotating bodies and the peripheral parts.

The present invention aims to provide an image formation apparatus and an image formation method that can appropriately control the temperature of the rotating bodies such as fixing rollers and pressure application rollers in the fixing device, so that the temperature does not become too high and does not become unnecessarily low, in a case of, in the standby state, stopping the rotating bodies and regulating the temperature thereof to reach a predetermined standby temperature.

SUMMARY OF INVENTION

In order to achieve the above aim, a first aspect of the present invention is an image formation apparatus that forms an image by causing a recording sheet on which an unfixed image has been formed to pass through a fixing nip between a pair of rotating bodies, at least one of which is a heat rotating body, including: a judgment part operable to judge whether to transition from a fixing state to a standby state, the standby state being a state in which the pair of rotating bodies stops rotating and temperature control is performed so that at least one of the rotating bodies reaches a predetermined standby temperature, and the fixing state being a state in which the pair of rotating bodies are rotating, and temperature control is performed so that the at least one of the rotating bodies reaches a fixing temperature that changes in accordance with a setting; and a fixing controller operable to, upon a judgment by the judgment part to transition to the standby state, prior to performing temperature control to reach the standby temperature, cause the pair of rotating bodies to rotate, and perform temperature control so that the temperature of the at least one of the rotating bodies reaches a predetermined transition temperature range including temperatures higher than a lower limit of a temperature that is permissible as the fixing temperature, and lower than an upper limit of a temperature that is permissible as the fixing temperature.

Also, a second aspect of the present invention is an image formation method in which an image is formed by causing a recording sheet on which an unfixed image has been formed to pass through a fixing nip between a pair of rotating bodies, at least one of which is a heat rotating body, including a judging step of judging whether to transition from a fixing state to a standby state, the standby state being a state in which the pair of rotating bodies stops rotating and temperature control is performed so that at least one of the rotating bodies reaches a predetermined standby temperature, and the fixing state being a state in which the pair of rotating bodies are rotating, and temperature control is performed so that the at least one of the rotating bodies reaches a fixing temperature that changes in accordance with a setting; and a fixing control step of, upon a judgment by the judgment part to transition to the standby state, prior to performing temperature control to reach the standby temperature, causing the pair of rotating bodies to rotate, and performing temperature control so that the temperature of the at least one of the rotating bodies reaches a predetermined transition temperature range including temperatures higher than a lower limit of a temperature that is permissible as the fixing temperature, and lower than an upper limit of a temperature that is permissible as the fixing temperature.

According to this structure, prior to performing temperature control to reach the standby state, when the fixing temperature is the highest temperature that can be set, the rotating bodies in the fixing device are caused to rotate, and the temperature is regulated to be a lower temperature than the fixing temperature at that time. Once the temperature of the rotating bodies has been lowered, the rotating bodies are stopped. Therefore, this structure enables alleviating the negative influence of a temperature elevation in the rotating bodies due to stopping the rotation thereof. In addition, when the fixing temperature is the lowest temperature that can be set, the rotating bodies in the fixing device are caused to rotate, and the temperature is regulated to be a higher temperature than the fixing temperature at that time. Once the temperature of the rotating bodies has been raised, a transition is made to the standby state. Therefore, in a case in which a temperature regulation setting in the standby state is set to a high temperature, this structure enables reducing the length of time that heat is continuously applied to the rotating bodies, reducing the amount of overshoot, and alleviating the negative influence of overshoot.

Accordingly, the temperature of the rotating bodies can be appropriately controlled so that the temperature neither becomes too high nor reaches, as in the conventional technology, an unnecessarily low temperature.

BRIEF DESCRIPTION OF DRAWINGS

These and other objects, advantages, and features of the invention will become apparent from the following description thereof taken in conjunction with the accompanying drawings, which illustrate specific embodiments of the present invention.

In the drawings:

FIGS. 6A and 6B show, when the image formation apparatus is set to normal printing using normal paper, a regulated temperature on a heater side and a behavior of a surface temperature of a heat application roller 51, based on an output of a thermistor 58 on the heater side, wherein FIG. 6A shows an example of control performed in the present embodiment, and FIG. 6B shows a conventional example in which the control pertaining to the present embodiment is not performed and when a final sheet passes through a fixing nip, a transition is made quickly from a fixing state to a standby state;

FIGS. 7A and 7B show, when the image formation apparatus is set to high-gloss printing using normal paper, a regulated temperature on the heater side and the behavior of the surface temperature of the heat application roller 51, based on the output of the thermistor 58 on the heater side, wherein FIG. 7A shows an example of control performed in the present embodiment, and FIG. 7B shows a conventional example in which the control pertaining to the present embodiment is not performed, and when a final sheet passes through a fixing nip, the transition is made quickly from the fixing state to the standby state;

DESCRIPTION OF PREFERRED EMBODIMENTS

Embodiment 1

Overview

Embodiment 1 is an image formation apparatus including a fixing device. In a case of, in a standby state, causing rotating bodies in the fixing device to stop and regulating a temperature thereof so that a predetermined standby temperature is reached, upon judging that fixing has finished, the image formation apparatus of embodiment 1 lowers the regulated temperature when a fixing temperature is comparatively high, and raises the regulated temperature when the fixing temperature is comparatively low, without causing the rotating bodies to stop. The image formation apparatus thereafter causes the rotating bodies to stop, and after a temperature elevation due to stopping the rotation of the rotating bodies has subsided, controls the temperature of the rotating bodies appropriately so that the temperature of the rotating bodies does not become too high and does not become unnecessarily low by raising the regulated temperature to the standby temperature.

Structure

An overall structure of the image formation apparatus pertaining to embodiment 1 is described below with reference to FIG. 1.

Figure 1:
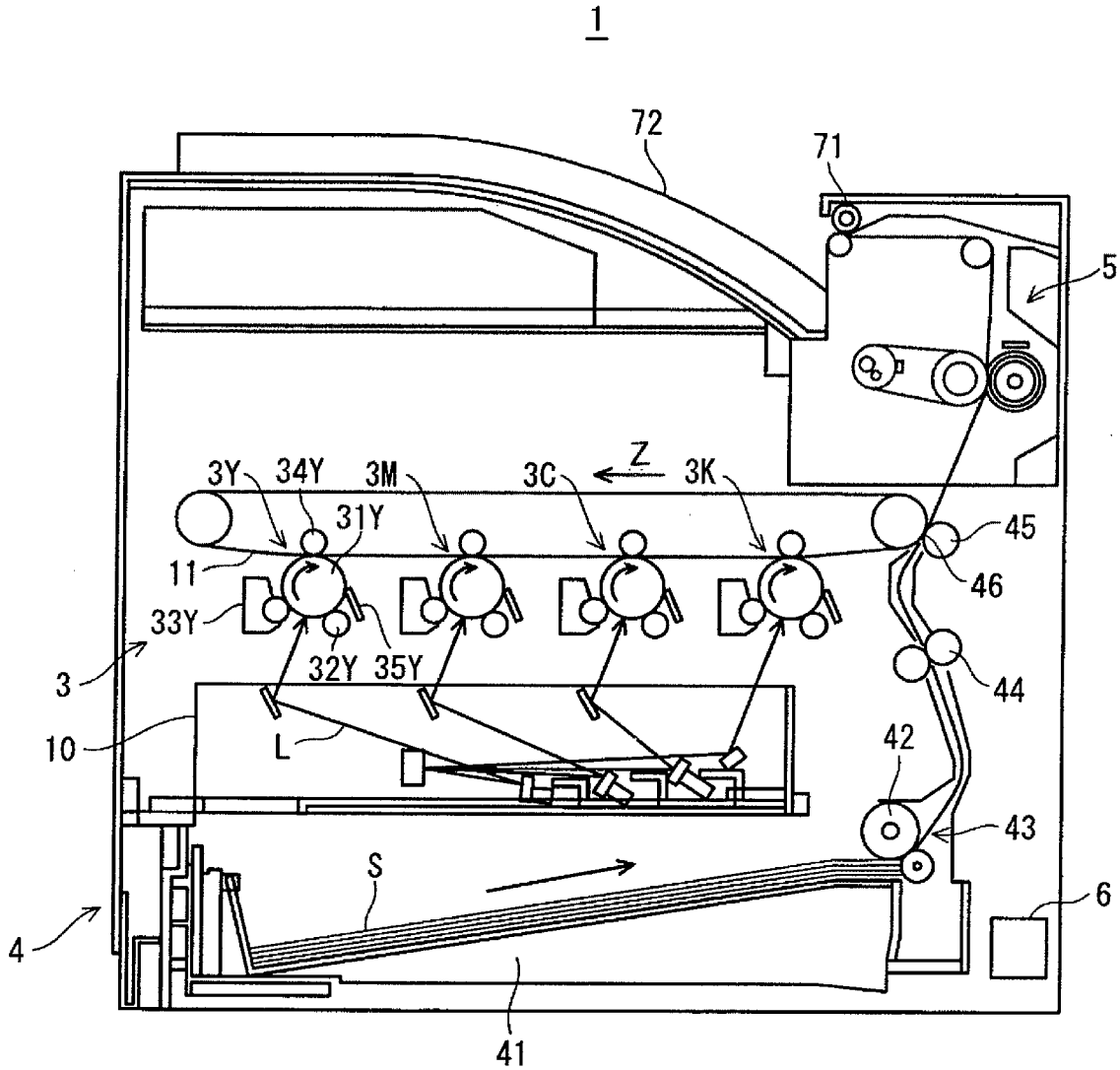
FIG. 1 shows an overall structure of an image formation apparatus according to embodiment 1.

As shown in FIG. 1, an image formation apparatus 1 pertaining to embodiment 1 is a tandem-type color digital printer including an image processor 3, a feeder 4, a fixer 5, and a controller 6. The image formation apparatus 1 is connected to a network (for example, an intra-company LAN), and upon receiving a print execution instruction from an intra-company terminal apparatus, forms a color image on a recording sheet and outputs the color image according to the print execution instruction.

The image processor 3 assumes the main responsibility for image formation. In the image processor 3, image formation units 3Y, 3M, 3C, and 3K for forming toner images in yellow, magenta, cyan, and black respectively are arranged in order along an intermediate transfer belt 11 that revolves in the direction indicated by an arrow Z. An optical part 10 including a luminous element such as a laser diode is disposed below each image formation unit. Note that in the image processor 3, an image formation unit whose main constituent element has a reference number ending in "Y" generates an image using yellow toner, an image formation unit whose main constituent element has a reference number ending in "M" generates an image using magenta toner, an image formation unit whose main constituent element has a reference number ending in "C" generates an image using cyan toner, and an image formation unit whose main constituent element has a reference number ending in "K" generates an image using black toner.

An image formation unit 3Y includes a photoreceptor drum 31Y, and also includes a charger 32Y, a developer 33Y, a primary transfer roller 34Y, and a cleaner 35Y that are arranged around the photoreceptor drum 31Y.

To generate an image using yellow toner, the charger 32Y uniformly charges the photoreceptor drum 31Y, the optical part 10 emits a laser beam L towards the uniformly charged photoreceptor drum 31Y according to control performed by the controller 6, thus forming an electrostatic latent image, the formed electrostatic latent image is developed using yellow toner by the developer 33Y, and the developed toner image is primarily transferred to the intermediate transfer belt 11. After the primary transfer, toner that remains in the photoreceptor drum 31Y is removed with use of the cleaner 35Y.

The image formation units 3M, 3C, and 3K also include similar structures (omitted from the reference notations in the drawings) to the image formation unit 3Y, and similarly generate images in each respective color of toner.

Each time the toner image, primarily transferred to the intermediate transfer belt 11, passes through one of the image formation units, the color of toner corresponding to the image formation unit is superimposed over the toner image, so that ultimately a full color toner image is generated.

Meanwhile, the feeder 4 assumes the main responsibility for conveying the recording sheet. The feeder 4 includes a feed cassette 41 that stores a recording sheet S, a reel roller 42 that reels the stored recording sheet S one sheet at a time to a conveyance path 43, a timing roller pair 44 that measures a timing of sending the reeled-out recording sheet S, and a secondary transfer roller 45. The recording sheet S is conveyed to a secondary transfer position 46, and a full color toner image generated by the intermediate transfer belt 11 is secondarily transferred to the recording sheet S in the secondary transfer position 46.

The fixer 5 applies heat and pressure to the recording sheet S, to which the toner image has been secondarily transferred, and causes the toner image to be fixed to the recording sheet S. The fixer 5 is described in detail below.

After the fixing, the recording sheet S is discharged to a copy receiving tray 72 via a drive by a discharge roller 71 or the like.

The controller 6 is a controller that collectively controls all of the operations of the image formation apparatus. Based on data of the image to be formed, the controller 6 generates a drive signal for a luminous element of the optical part 10 separately for each image formation unit, and adjusts a timing so that in the primary transfer, the toner image for each color is accurately superimposed, and in the secondary transfer, the toner image is accurately transferred to the recording sheet S.

The structure of the fixer 5 is described below with reference to FIG. 2.

Figure 2:
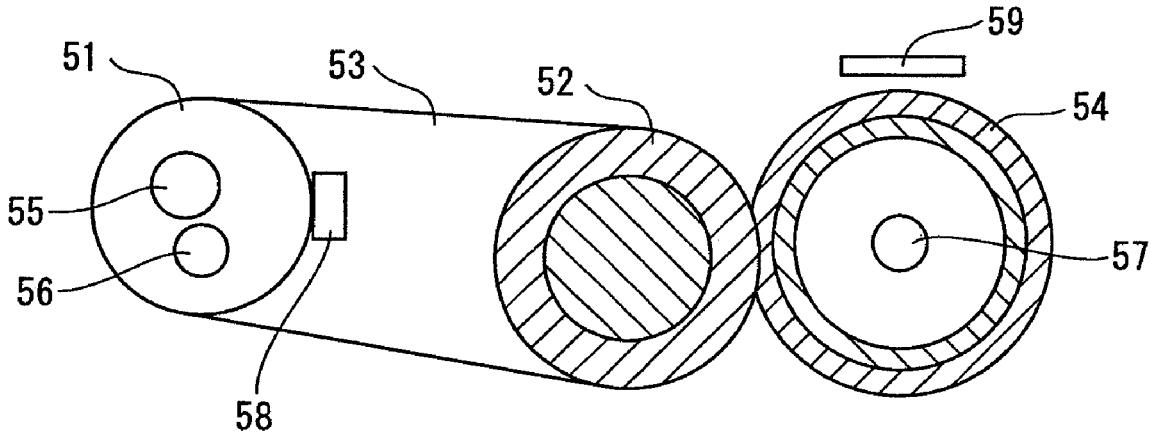
FIG. 2 diagrammatically shows a structure of a fixer 5.

As shown in FIG. 2, the fixer 5 includes a fixing belt 53 that loops around a heat application roller 51 and a fixing roller 52, and a pressure application roller 54 disposed in a vicinity of the fixing belt 53. A fixing nip is formed at a contact portion between the fixing belt 53 and the pressure application roller 54.

The heat application roller 51 is formed by layering a mold release layer, etc., composed of fluoride resin or the like, on a surface of a cylindrical steel or aluminum pipe (for example, 25 mm outer diameter, 0.6 mm of aluminum metal having a hollow core+a 15μ PTFE coat, the nip measuring approximately 330 mm in the length direction). When applying tensile force to the fixing belt 53 along with the fixing roller 52, the heat application roller 51 drives the rotation of the fixing belt 53 in accordance with the speed at which the recording sheet is passing through.

Also, a long heater 55 (for example, a 990 W halogen lamp heater having a 290 mm luminous length) and a short heater 56 (for example, a 790 W halogen lamp heater having a 180 mm luminous length) are inserted in the heat application roller 51. The heat application roller 51 is heated by heat generated by the long heater 55 or the short heater 56, the heat is transmitted to the fixing belt 53, and the fixing belt 53 is heated to a fixing temperature.

The fixing roller 52 is formed by layering an elastic layer of silicon rubber, sponge etc. on a surface of cylindrical steel or aluminum (for example, 30 mm outer diameter, a ϕ22 mm steel solid core metal+4 mm of rubber+2 mm of sponge, the nip measuring approximately 330 mm in the length direction).

The fixing belt 53 is formed of multilayers such as a mold release layer composed of fluoride resin, etc. and an elastic layer of silicon rubber, etc. on a surface of a heat-resistant layer composed of polyimide resin or nickel base material or the like, and so the fixing belt 53 has flexibility (for example, 60 mm outer diameter, 45 μm of nickel base material+200 μm of rubber+30 μm of PFA, the nip measuring approximately 320 mm in the length direction).

The pressure application roller 54 is formed of multilayers, such as an elastic layer of silicon rubber or the like and a mold release layer composed of fluoride resin or the like on a surface of a cylindrical pipe made of steel or aluminum (for example, 35 mm outer diameter, 2.5 mm of steel metal having a hollow core+2.5 mm of rubber+30 μm of PFA, the nip measuring approximately 330 mm in the length direction).

Also, a pressure application heater 57 (for example, a 230 W halogen lamp heater having a 290 mm luminous length) is inserted into the pressure application roller 54, and the pressure application roller 54 is heated by heat from the pressure application heater 57.

Also, the depicted fixer 5 further includes the heater side thermistor 58 (for example, disposed so as to be in contact with two portions, the two portions being respectively positioned 40 mm and 140 mm from a reference position in a center of an area that a sheet passes through), and the pressure application side thermistor 59 (for example, disposed so as not to be in contact with the position 40 mm from the reference position in the center of the area that the sheet passes through), each of which respectively outputs voltage corresponding to the surface temperatures of the heat application roller 51 and the pressure application roller 54.

The functional structure of the image formation apparatus 1 of embodiment 1 is described below with reference to FIG. 3.

Figure 3:
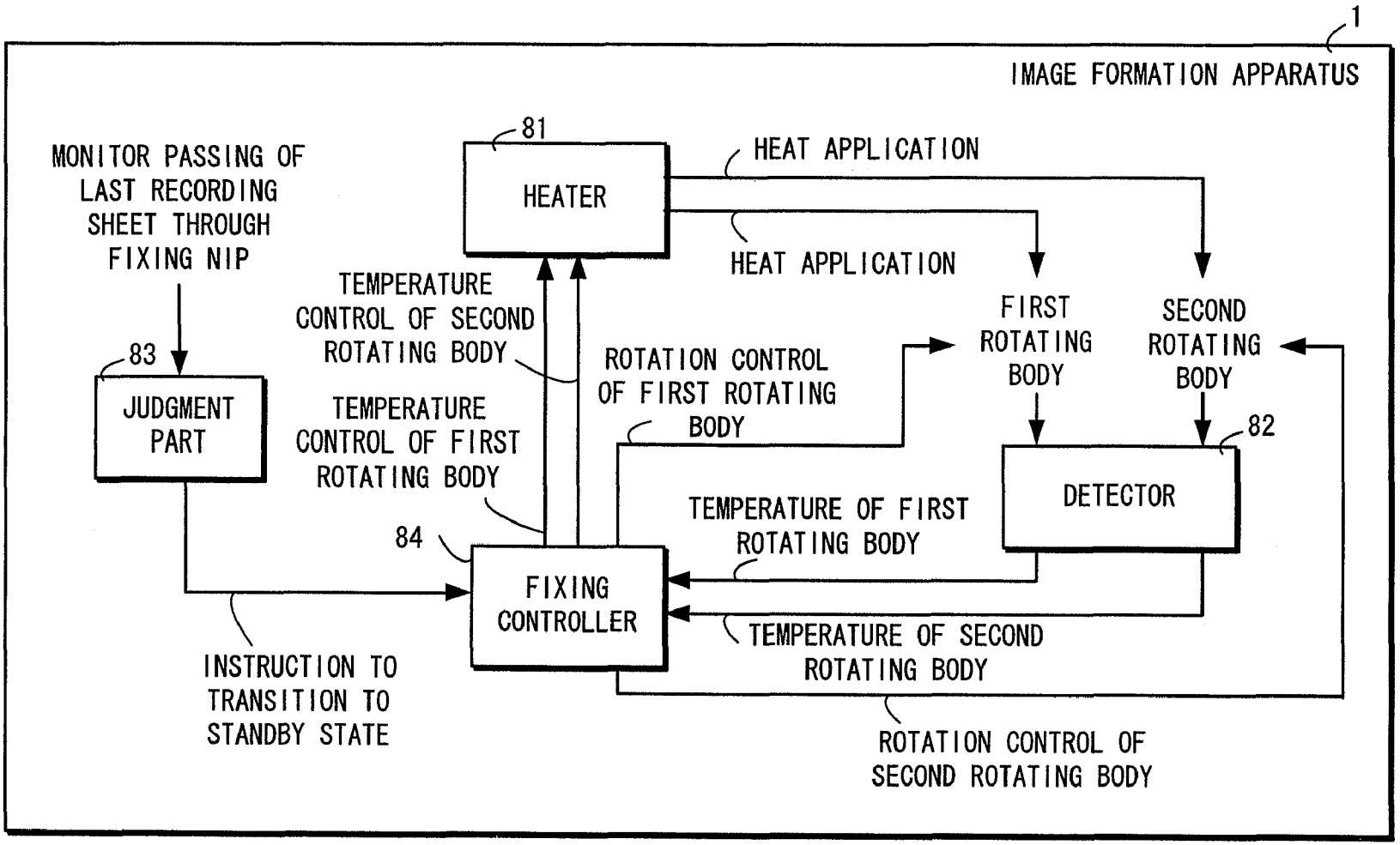
FIG. 3 shows a functional structure of an image formation apparatus 1 according to embodiment 1.

As shown in FIG. 3, the image formation apparatus 1 includes a heater 81, a detector 82, a judgment part 83, and a fixing controller 84.

The heater 81 applies heat to at least one of the pair of rotating bodies that form the fixing nip, and corresponds to the long heater 55, the short heater 56, and the pressure application heater 57 in FIG. 2. The long heater 55 and the short heater 56 apply heat to a first rotating body made up of the heat application roller 51, the fixing roller 52, and the fixing belt 53. The pressure application heater 57 applies heat to a second rotating body made up of the pressure application roller 54.

The detector 82 is for detecting a temperature of the rotating bodies that are heated by the heater 81, and corresponds to the heater side thermistor 58 and the pressure application side thermistor 59 in FIG. 2. The heater side thermistor 58 detects the temperature of the first rotating body, and the pressure application side thermistor 59 detects the temperature of the second rotating body.

The judgment part 83 corresponds to a portion of the control performed by the controller 6 in FIG. 1, and judges whether to transition from a fixing state to a standby state. Upon recognizing that a last recording sheet for which an image is to be formed in the fixing state has passed through the fixing nip, the judgment part 83 makes a judgment to transition to the standby state.

The fixing controller 84 corresponds to a portion of the control performed by the controller 6 in FIG. 1. In a fixing state, when a judgment is made by the judgment part 83 to transition to a standby state, the fixing controller 84 causes one pair of the rotating bodies to rotate, and performs temperature regulation control so that the temperature of the rotating bodies reach a transition temperature range. Thereafter, the fixing controller 84 performs control to transition to the standby state. More specifically, prior to the regulation control to transition into the standby state, the fixing controller 84 regulates the temperature of the rotating bodies to be a first transition temperature that is in the transition temperature range. Thereafter, the fixing controller 84 stops the pair of rotating bodies, and controls the temperature of the temperature-controlled rotating bodies to be a second transition temperature. In the present embodiment, the standby temperature and the fixing temperature on the pressure application side are set as comparatively low temperatures. Therefore, since it is thought that there is no negative influence due to a temperature elevation when stopping the rotation of the pressure application roller 54 or continuously applying heat for a long period of time to the pressure application heater 57, a transition state is not provided on the pressure application side, and the pressure application side is set to transition to a standby state in accordance with the timing of stopping the rotating bodies on the heater side. Note that when the standby temperature and the fixing temperature on the pressure application side are set as comparatively high temperatures, it is preferable to also provide a transition state on the pressure application side, and to perform similar control as the heater side. Also, in contrast to the present embodiment, when the standby temperature and fixing temperature on the heater side are comparatively low, and the standby temperature on the pressure application side is high, and the fixing temperature on the pressure application side has a range depending on the fixing temperature conditions, a transition state may be provided only on the pressure application side and not on the heater side.

Here, the transition temperature range encompasses temperatures that are higher than the lowest temperature that can be set as the fixing temperature, and are lower than the highest temperature that can be set as the fixing temperature. In the present embodiment, on the heater side, the fixing temperature is between approximately 140° C. and 200° C., and the transition temperature range is the range of temperatures lower than 200° C. and higher than 140° C., and for example the first transition temperature is 160° C.

Also, the standby temperature is in the vicinity of a highest fixing temperature that can be set, and in the present embodiment, is in the vicinity of 200° C., and is, for example 185° C.

Also, the second transition temperature is a temperature that is somewhat lower than the standby temperature, and in the present embodiment is, for example, 165° C.

Operation

The procedure of processing by which the controller 6 appropriately controls the temperature of the rotating bodies of the fixer 5 in the present embodiment is described below with reference to FIGS. 4 and 5.

(1) When power is applied, the fixing controller 84 causes the rotating bodies of the fixer 5 to rotate, sets a regulated temperature on the heater side to a first initial temperature, and sets a regulated temperature on the pressure application side to the standby temperature (step S1). In the present embodiment, the rotating bodies of the fixer 5 are set to rotate at a linear speed of 90 mm/s, and when performing temperature control of the heat application roller 51, while monitoring the output of the heater side thermistor 58, the controller 6 sets the regulated temperature on the heater side to the first initial temperature which is 135° C., and performs on/off control of the long heater 55. Similarly, when performing temperature control of the pressure application roller 54, while monitoring the output of the pressure application side thermistor 59, the controller 6 sets the regulated temperature on the pressure application side to the standby temperature on the pressure application side which is 135° C., and performs on/off control of the pressure application heater 57.

(2) The controller 6 waits for the temperature of the rotating bodies on the heater side to reach the first initial temperature (step S2). In the present embodiment, the controller 6 waits until the output of the heater side thermistor 58 reaches 135° C.

(3) When the temperature of the rotating bodies on the heater side reaches the first initial temperature (step S2:YES), the controller 6 waits a predetermined time period, corresponding to an amount of time for the temperature to stabilize, to pass (step S3). In the present embodiment, the controller 6 waits 10 seconds.

(4) When the predetermined time period has passed (step S3:YES), the controller 6 stops the rotation of the rotating bodies of the fixer 5, and sets the regulated temperature on the heater side to the second initial temperature (step S4). In the present embodiment, the regulated temperature on the heater side is set to 165° C.

(5) The controller 6 waits a predetermined time period, corresponding to the amount of time for the temperature of the rotating bodies on the heater side to stabilize (step S5). In the present embodiment, the controller 6 waits 10 seconds.

(6) When the predetermined time period has passed (step S5:YES), the controller 6 sets the regulated temperature on the heater side to the standby temperature on the heater side (step S6). In the present embodiment, the standby temperature on the heater side is 185° C.

(7) The controller 6 waits until the respective temperatures of the rotating bodies on the heater side and on the pressure application side reach the respective standby temperatures (step S7). In the present embodiment, the controller 6 waits until the output of the thermistor 58 on the heater side indicates 185° C. even once, and the output of the thermistor 59 on the pressure application side indicates 135° C. even once.

(8) When the respective temperatures of the rotating bodies on the heater side and on the pressure application side reach the respective standby temperatures (step S7:YES), warm-up is finished, the heater side and the pressure application side enter the standby state, and the controller 6 waits to receive an instruction to start printing either directly from a user or via a PC (personal computer), etc. (step S8).

(9) Upon receiving the instruction to start printing (step S8, step S13, step S16:YES), the heater side and the pressure application side enter the fixing state, and printing is performed. Specifically, the controller 6 causes the rotating bodies of the fixer 5 to rotate, and sets the regulated temperatures of the heater side and the pressure application side to the respective fixing temperatures (step S9). In the present embodiment, for example when set to normal printing using normal paper, the fixing control unit causes the rotating bodies of the fixer 5 to rotate at a linear speed of 90 mm/s, and when performing regulation control of the heat application roller 51, while monitoring the output of the heater side thermistor 58, the controller 6 sets the regulated temperature on the heater side to the fixing temperature on the heater side which is 185° C. The controller 6 performs on/off control on the short heater 56 when the width of the recording sheet is equal to or less than 216 mm, and on the long heater 55 when the width of the recording sheet exceeds 216 mm. Similarly, when performing temperature control of the pressure application roller 54, while monitoring the output of the pressure application side thermistor 59, the controller 6 sets the regulated temperature on the pressure application side to the fixing temperature on the pressure application side which is 135° C., and performs on/off control of the pressure application heater 57. Also, for example, when set to perform high-gloss printing on normal paper, compared to a case of being set to perform normal printing on normal paper, the linear speed of the rotating bodies of the fixer 5 is different in being 45 mm/s, and the fixing temperature on the heater side is different in being 145° C., and the other control is similar to the case of normal printing on normal paper.

(10) The judgment part 83 waits to recognize that a last recording sheet for which an image is to be formed in the fixing state has passed through the fixing nip (step S10).

(11) When the last sheet has passed through the fixing nip (step S10:YES), the controller 6 transitions the heater side of the fixer 5 to the transition state. First, without stopping the rotation of the rotating bodies of the fixer 5, the controller 6 sets the regulated temperature on the heater side to the first transition temperature (step S1). In the present embodiment, the controller 6 causes the rotating bodies of the fixer 5 to rotate at the linear speed of 45 mm/s, and sets the regulated temperature on the heater side to the first transition temperature which is 160° C.

(12) The controller 6 waits until the temperature of the rotating bodies on the heater side is less than or equal to a temperature that is a predetermined amount lower than the fixing temperature (step S12).

(13) The controller 6 waits a predetermined time period, corresponding to an amount of time for the temperature to stabilize, to pass (step S13).

In the present embodiment, the controller 6 waits until either the temperature reaches a temperature 10° C. lower than the fixing temperature, or 10 seconds has passed, whichever condition is fulfilled first. For example, when set to normal printing using normal paper, since the fixing temperature is 185° C., the controller 6 waits until either the temperature reaches 175° C. that is 10° C. lower than 185° C., or until 10 seconds have passed, whichever condition is fulfilled first, and usually the temperature reaches 175° C. before 10 seconds have passed. Also, for example when set to high-gloss printing using normal paper, since the fixing temperature is 145° C., the controller 6 waits until either the temperature reaches 135° C. that is 10° C. lower than 145° C., or 10 seconds have passed, whichever condition is fulfilled first. At this time, since the regulated temperature is 160° C., when the temperature is raised from 145° C. to 160° C. it does not reach 135° C., so 10 seconds pass.

(14) An instruction to start printing is received while waiting for either the temperature of the rotating bodies on the heater side to be less than or equal to a temperature less than the fixing temperature by the predetermined amount, or for the predetermined time period to pass (step S12:NO, step S13:NO, step S14).

(15) When the temperature of the rotating bodies on the heater side is less than or equal to a temperature less than the fixing temperature by the predetermined amount (step S12:YES) or when the predetermined time period has passed (step S13:YES), the controller 6 stops the rotation of the rotating bodies of the fixer 5, sets the regulated temperature on the pressure application side to the standby temperature, and sets the regulated temperature on the heater side to the second transition temperature (step S15). In the present embodiment, the controller 6 stops the rotation of the rotating bodies of the fixer 5, sets the regulated temperature on the heater side to the second transition temperature which is 165° C., and sets the regulated temperature on the pressure application side to the standby temperature which is 135° C.

(16) The controller 6 waits a predetermined time period, corresponding to an amount of time for the temperature to stabilize, to pass (step S16). In the present embodiment, the controller 6 waits 25 seconds.

(17) An instruction to start printing is received while waiting for the predetermined time period to pass (step S16:NO, step S17).

(18) When the predetermined time period has passed (step S16:YES), the heater side of the fixer 5 enters the standby state. Specifically, the controller 6 sets the regulated temperature on the heater side to the standby temperature, and returns to waiting for an instruction to start printing (step S18). In the present embodiment, the regulated temperature on the heater side is set to the standby temperature which is 185° C.

Verification of Results

Figure 6A:
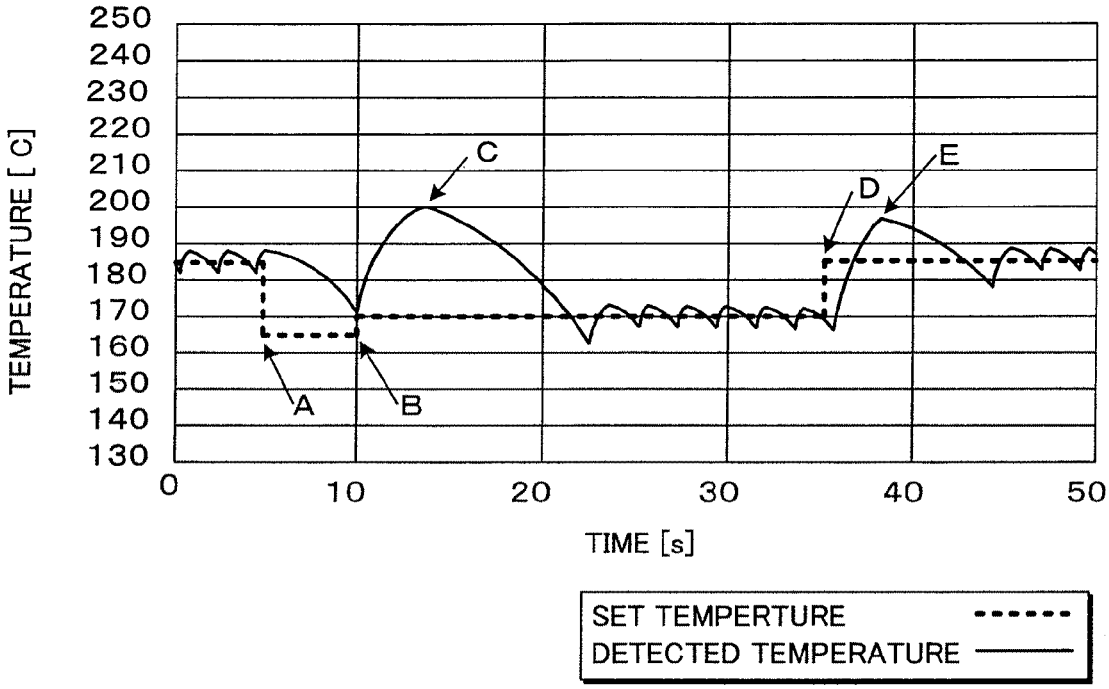
Figure 6B:
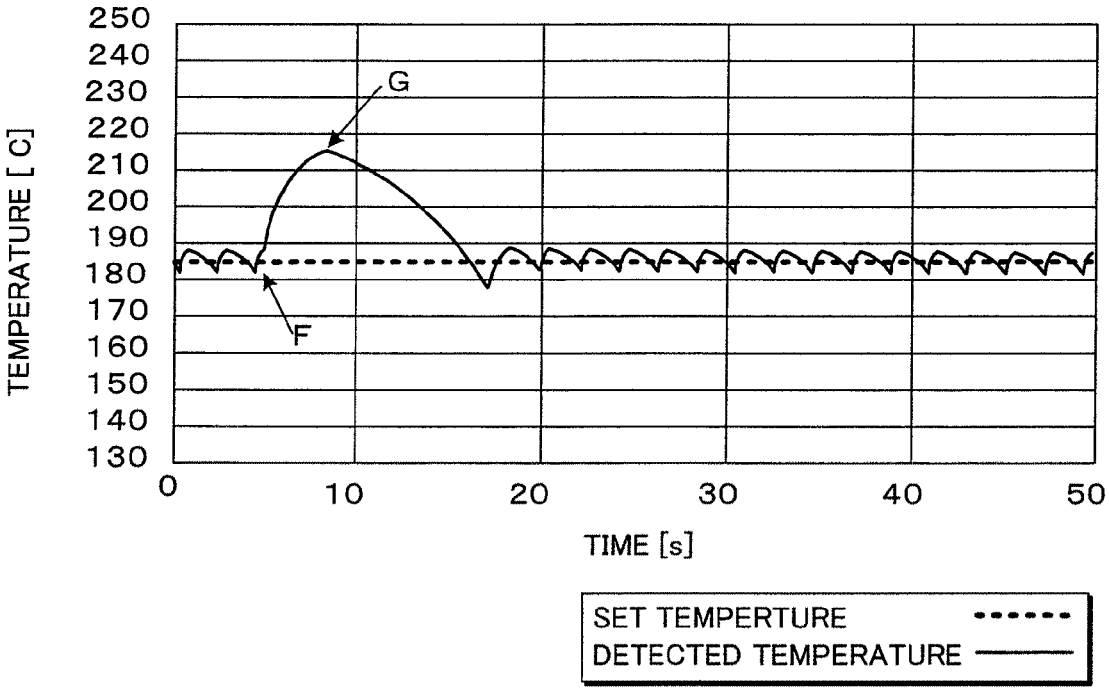
FIG.6B (PRIOR ART)

The following describes the behavior of the surface temperature of the heat application roller 51 based on the regulated temperature on the heater side and the output of the heater side thermistor 58, when set to normal printing using normal paper, with reference to FIGS. 6A and 6B.

When the fixing temperature is comparatively high at 185° C. and the standby temperature is also comparatively high at 185° C. in this way, as shown in FIG. 6A, in the control of the present embodiment, when the last sheet passes through the fixing nip (point A in the drawing), the regulated temperature (the set temperature: shown as a dotted line in the drawings) is lowered from 185° C. to 165° C. while the rotating bodies are rotating. Therefore, the surface temperature of the heat application roller (the detected temperature: a solid line in the drawing) gradually falls, and after the temperature has fallen a certain amount (point B in the drawing), the regulated temperature is changed from 165° C. to 170° C. and the rotation of the rotating bodies stops. Therefore, the surface temperature of the heat application roller begins to rise, and for the subsequent 25 seconds, in a peak of the surface temperature (point C in the drawing), the temperature elevates once to approximately 200° C., and thereafter a temperature in a vicinity of 170° C. is maintained. After the 25 seconds have passed (point D in the drawing), the regulated temperature is changed from 170° C. to 185° C. and a transition is made to the standby state, and there is a slight overshoot (point E in the drawing). Thereafter, the regulated temperature is maintained in the vicinity of 185° C. In contrast, in conventional control, as shown in FIG. 6B, when the last sheet passes through the nip (point F in the drawing), the regulated temperature switches from the fixing temperature to the standby temperature and since these are the same temperature, there is substantially no change in the regulated temperature, and the surface temperature of the heat application roller begins to rise since the rotation of the rotating bodies has stopped. The temperature rises once to approximately 215° C. at a peak of the surface temperature (point G in the drawing), and thereafter is maintained at a temperature in the vicinity of 185° C.

In this way, in the control of the present embodiment, since when the fixing temperature is high, the rotation of the rotating bodies is stopped after the regulated temperature has been lowered and as a result the surface temperature has been lowered, the temperature of the rotating bodies does not become too high.

Figure 7A:
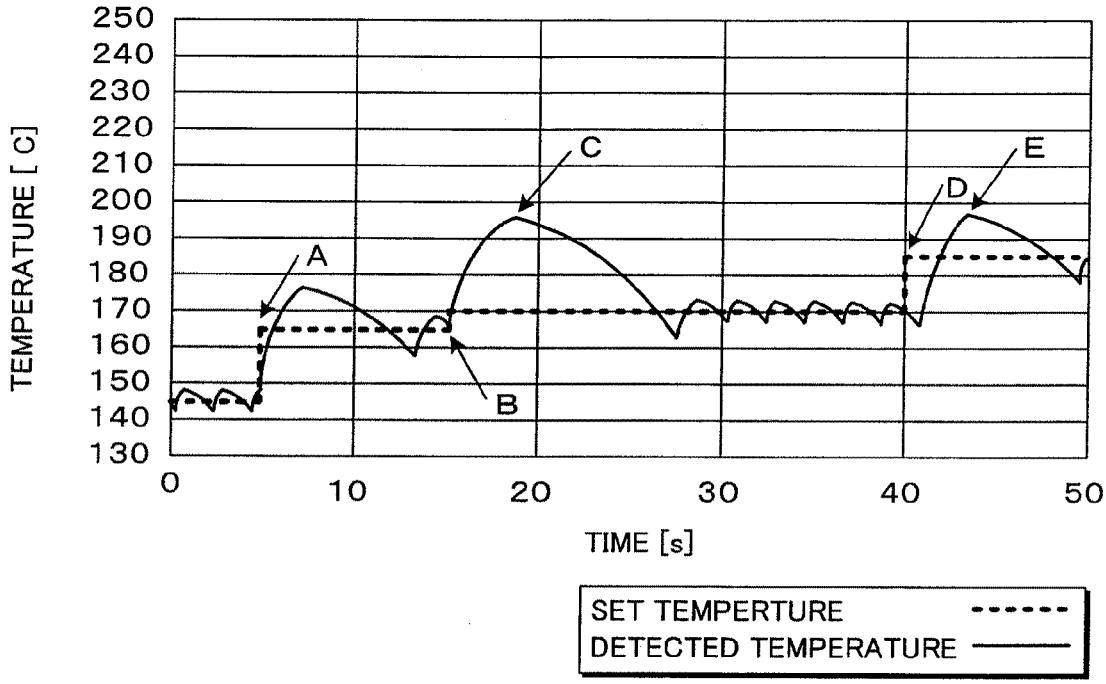
Figure 7B:
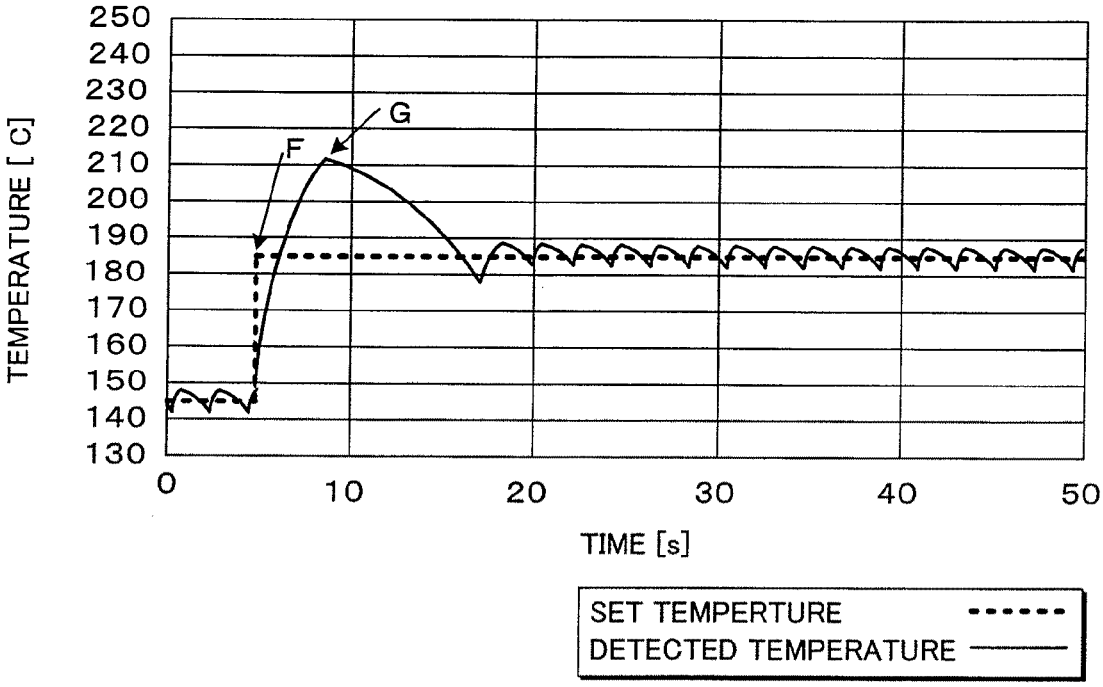
FIG.7B (PRIOR ART)

The following describes the behavior of the surface temperature of the heat application roller 51 based on the regulated temperature on the heater side and the output of the heater side thermistor 58, when set to normal printing using high-gloss paper, with reference to FIGS. 7A and 7B.

When the fixing temperature is comparatively low at 145° C. and the standby temperature is comparatively high at 185° C. in this way, as shown in FIG. 7A, in the control of the present embodiment, when the last sheet passes through the fixing nip (point A in the drawing), the regulated temperature (the set temperature: shown as a dotted line in the drawings) is raised from 145° C. to 165° C. while the rotating bodies are rotating. Therefore, the surface temperature of the heat application roller 51 (the detected temperature: a solid line in the drawing) gradually rises, a temperature in the vicinity of 165° C. is maintained for 10 seconds subsequent, and after the 10 seconds have passed (point B in the drawing), the regulated temperature is changed from 165° C. to 170° C. and the rotation of the rotating bodies stops. Therefore, the surface temperature of the heat application roller begins to rise, and for the subsequent 25 seconds, in a peak of the surface temperature (point C in the drawing), the temperature elevates once to approximately 190° C., and thereafter a temperature in a vicinity of 170° C. is maintained. After the 25 seconds have passed (point D in the drawing), the regulated temperature is changed from 170° C. to 185° C. and a transition is made to the standby state, and there is a slight overshoot (point E in the drawing). Thereafter, the regulated temperature is maintained in the vicinity of 185° C. In contrast, in conventional control, as shown in FIG. 7B, when the last sheet passes through the nip (point F in the drawing), the regulated temperature is changed from 145° C. to 185° C., and the surface temperature of the heat application roller begins to rise synergistically since the rotation of the rotating bodies has stopped. The temperature rises once to approximately 210° C. at a peak of the surface temperature (point G in the drawing), and thereafter is maintained at a temperature in the vicinity of 185° C.

In this way, in the control of the present embodiment, since when the fixing temperature is low, the rotation of the rotating bodies is stopped after the regulated temperature has been raised and therefore the surface temperature has been raised, the temperature of the rotating bodies and the peripheral parts does not become too high.

Additional Remarks

As described above, according to embodiment 1, in the transition state immediately after fixing has finished, after setting the regulated temperature in the transition temperature range while the rotating bodies are rotating, the rotation of the rotating bodies is stopped. After waiting the predetermined time period, the regulated temperature is raised to the standby temperature and a transition is made to the standby state. Therefore, whether the fixing temperature is high or low, the temperature of the rotating bodies does not become too high. Accordingly, a desirable effect can be obtained of avoiding overly high temperatures which lead to deterioration of the rotating bodies and the peripheral parts thereof. Also, even when the regulated temperature in standby is set to a high temperature, since the time period of continuously applying heat at one time is short, an amount of overshoot is small, and alleviating the negative influence of overshoot is possible.

Note that the first transition temperature and the second transition temperature may both be the same temperature, or one temperature may be higher than the other, provided that both temperatures are in the transition temperature range, reduce the amount of temperature elevation caused by stopping the rotation of the rotating bodies, and reduce the amount of overshoot at the same time, while not exceeding an allowable temperature.

Also, in the transition state, waiting for the predetermined time period to pass after stopping the rotation of the rotating bodies is not necessarily required. Specifically, an effect similar to the above-described effect can be achieved even when, in the transition state, after setting the regulated temperature in the transition temperature range while the rotating bodies are rotating, the rotation of the rotating bodies is stopped, the regulated temperature is raised to the standby temperature, and a transition is made to the standby state.

Also, in steps S3, S5, S13, and S16, waiting until one of the rotating bodies has rotated a predetermined number of times may be performed instead of waiting for the predetermined time period to pass (the same is true in the following variations 1 to 5).

Variation 1

Variation 1 is for performing further control when, in a transition state on the heater side, upon detecting a temperature of the rotating bodies, the actual measured temperature is a low temperature, so that the temperature of the rotating bodies does not become too low. In variation 1, when the actual measured temperature is a comparatively low predetermined temperature in a vicinity of a lower end of the transition temperature range, the first transition temperature is set to be greater than or equal to the predetermined temperature.

Figure 4:
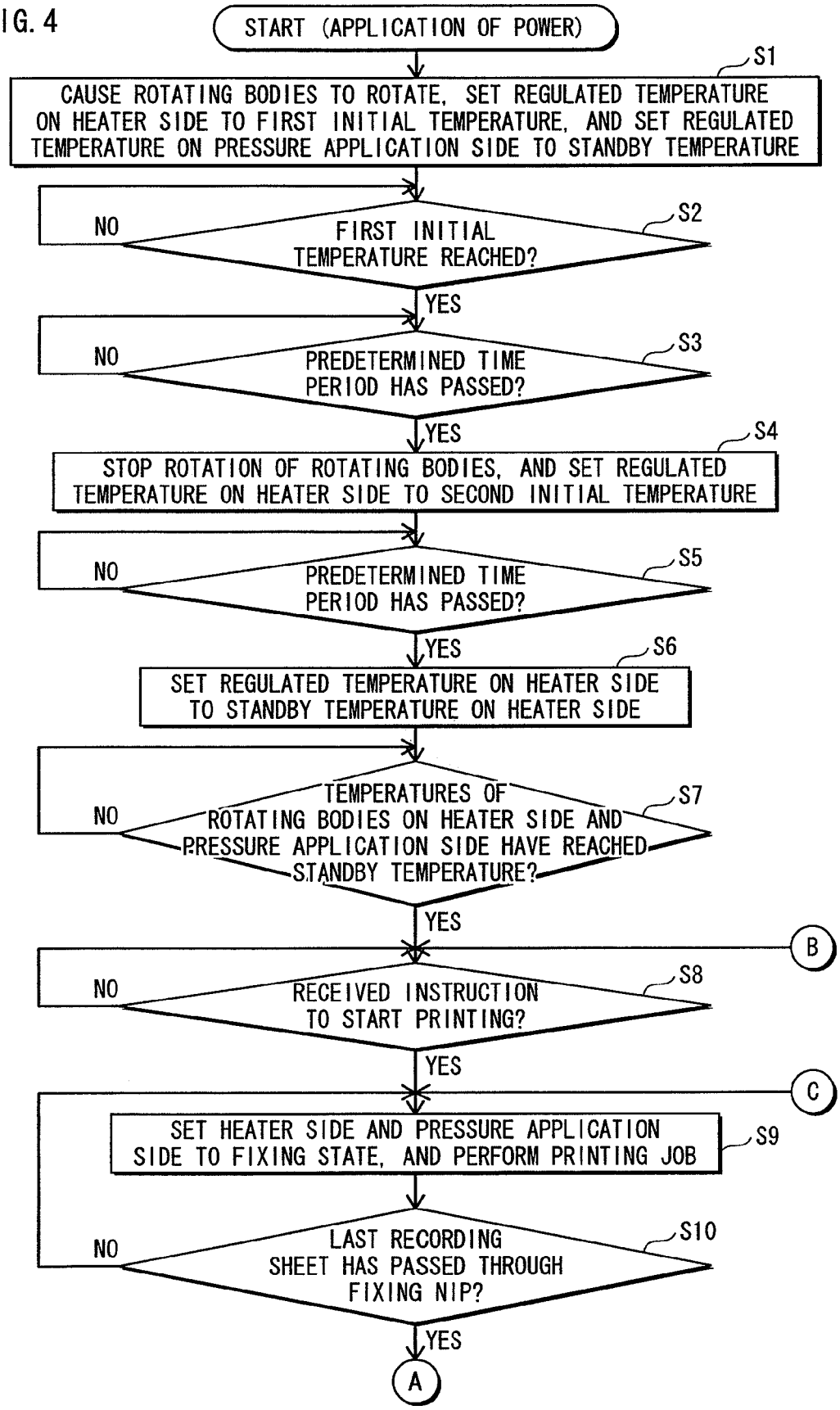
FIG. 4 shows a first half of a procedure for processing to appropriately control a temperature of rotating bodies of the fixer 5 according to embodiment 1.
Figure 5:
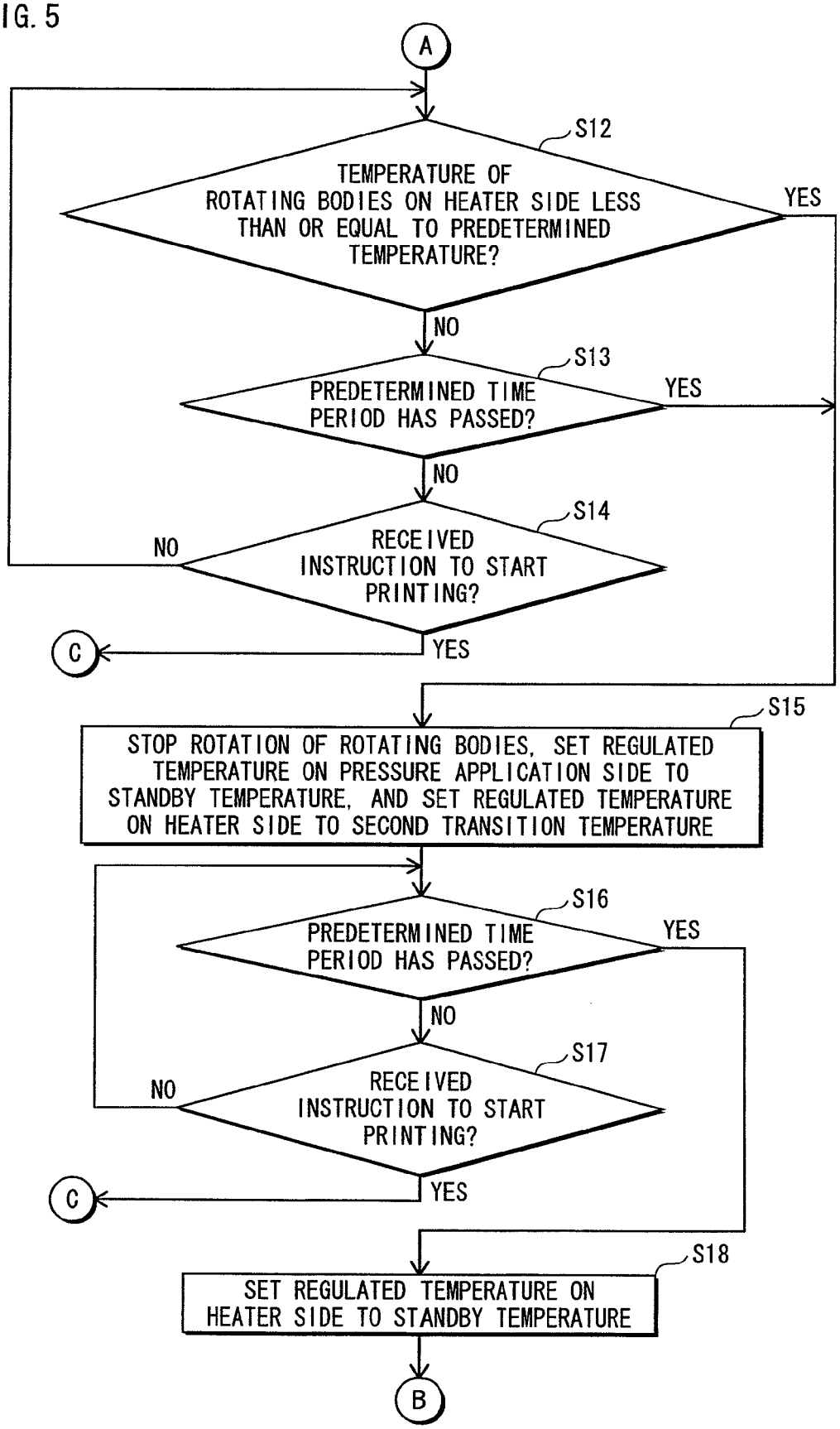
FIG. 5 shows a second half of the procedure for processing to appropriately control the temperature of the rotating bodies of the fixer 5 according to embodiment 1.
Figure 8:
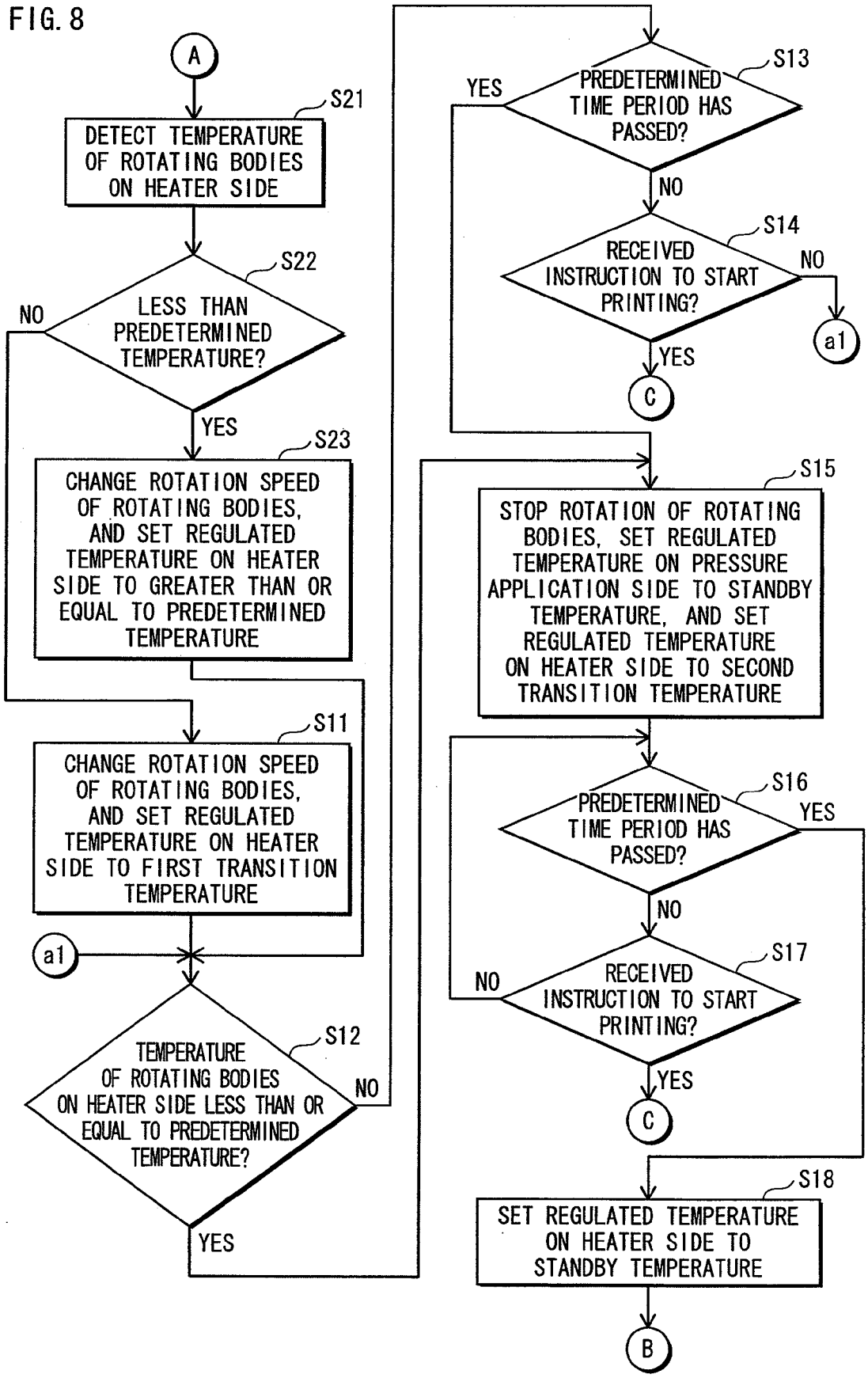
FIG. 8 shows a procedure for processing to appropriately control the temperature of the rotating bodies of the fixer 5 according to variation 1.

The following describes, with reference to FIGS. 4, 5, and 8, a procedure of processing for the controller 6 to appropriately control the temperature of the rotating bodies of the fixer 5.

Note that the steps in which processing is performed similarly to the procedure in FIGS. 4 and 5 in embodiment 1 are referred to by same numbers, and description thereof is omitted.

In (1) to (10), similar processing to (1) to (10) in FIG. 4 in embodiment 1 is performed (steps S1 to S10).

(11) When the last sheet has passed through the nip (step S10:YES), the temperature of the rotating bodies on the heater side is detected (step S21). Specifically, the surface temperature of the heat application roller 51 is detected based on the output of the heater side thermistor 58.

(12) A judgment is made as to whether the detected temperature of the rotating bodies is a lower temperature than a predetermined temperature in the transition temperature range (step S22). Specifically, since the transition temperature range encompasses temperatures lower than 200° C. and higher than 140° C., for example, a judgment is made as to whether the temperature is a lower temperature than 170° C.

(13) If a judgment is made that the detected temperature is lower than the predetermined temperature (step S22:YES), the controller 6 sets the regulated temperature to a temperature that is greater than or equal to the predetermined temperature without stopping the rotation of the rotating bodies, and causes the heater side of the fixer 5 to be in the transition state (step S23). In variation 1, the controller 6 causes the rotating bodies of the fixer 5 to rotate at the linear speed of 45 mm/s, and sets the regulated temperature on the heater side to be a temperature greater than or equal to the predetermined temperature, for example 170° C.

(14) If a judgment is made that the detected temperature is not lower than the predetermined temperature (step S22:NO), the same processing is performed as in (11) in FIG. 5 in embodiment 1 (step S11).

In (15) to (21), similar processing to (12) to (18) in FIG. 5 in embodiment 1 is performed (steps S12 to S18).

Additional Remarks

As described above, according to variation 1, when the temperature of the rotating bodies is lower than the predetermined temperature in the transition temperature range, since the temperature of the rotating bodies is actively raised, by setting the regulated temperature to greater than or equal to the predetermined temperature, the temperature of the rotating bodies can be raised appropriately in response to a case in which the temperature of the rotating bodies is actually low. Accordingly, this enables reducing the amount of time spent waiting for printing to start, and also shortening the amount of time until the standby state stabilizes.

Variation 2

Although in embodiment 1, the regulated temperature in the transition state is fixed, in variation 2, the regulated temperature is calculated appropriately as needed. Specifically, the regulated temperature is calculated based on a relationship between a fixing temperature that changes according to a set of conditions and a lower end of the transition temperature range.

Figure 9:
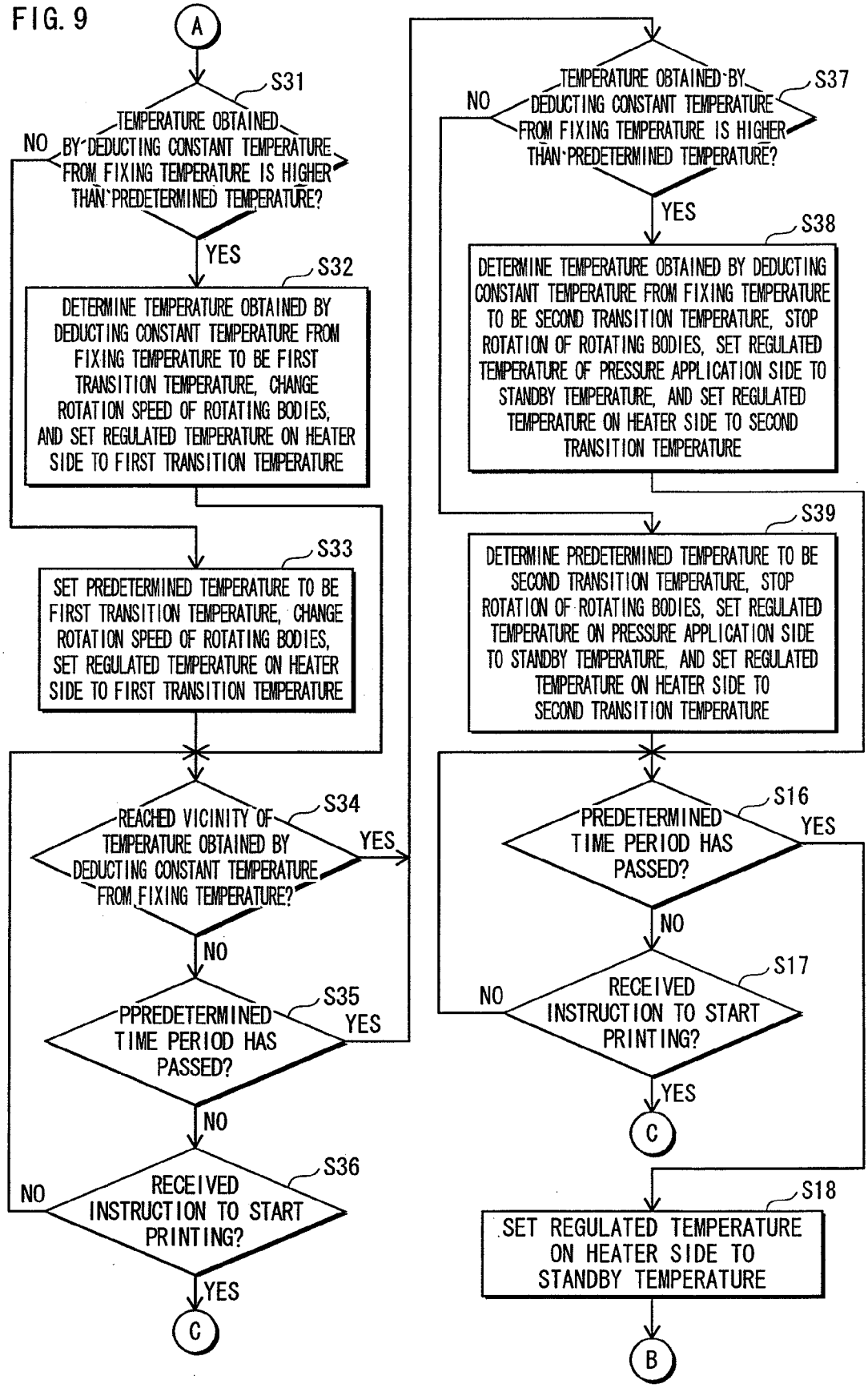
FIG. 9 shows a procedure for processing to appropriately control the temperature of the rotating bodies of the fixer 5 according to variation 2.

The following describes, with reference to FIGS. 4, 5, and 9, a procedure of processing for the controller 6 to appropriately control the temperature of the rotating bodies of the fixer 5.

Note that the steps in which processing is performed similarly to the procedure in FIGS. 4 and 5 in embodiment 1 are referred to by same numbers, and description thereof is omitted.

In (1) to (10), similar processing to (1) to (10) in FIG. 4 in embodiment 1 is performed (steps S1 to S10).

(11) When the last sheet has passed through the nip (step S10:YES), the controller 6 calculates the first transition temperature that is one of the regulated temperatures in the transition state. First, a judgment is made as to whether a temperature obtained by deducting a constant temperature from the fixing temperature is higher than a predetermined temperature in the vicinity of the lower end of the transition temperature range (step S31). In variation 2, a judgment is made as to whether the temperature obtained by deducting, for example, 20° C. from the regulated temperature in the fixing state, is higher than, for example, 150° C. that is in the vicinity of the lower end of the transition temperature range. For example, when the regulated temperature in the fixing state is 185° C., since the temperature obtained by deducting 20° C. is 165° C., a judgment is made that the temperature is higher than 150° C., and when the regulated temperature in the fixing state is 145° C., since the temperature obtained by deducting 20° C. is 125° C., a judgment is made that the temperature is lower than 150° C.

(12) If a judgment is made that the obtained temperature is higher (step S31:YES), the obtained temperature is determined to be the first transition temperature, and without stopping the rotation of the rotating bodies of the fixer 5, the controller 6 sets the regulated temperature on the heater side to the first transition temperature (step S32). In variation 2, the controller 6 causes the rotating bodies of the fixer 5 to rotate at the linear speed of 45 mm/s, and sets the regulated temperature on the heater side to the temperature obtained by deducting 20° C. from the regulated temperature in the fixing state. For example, when the regulated temperature in the fixing state is 185° C., the regulated temperature on the heater side is set to 165° C.

(13) When a judgment is made that the obtained temperature is not higher (step S31:NO), the controller 6 determines the predetermined temperature in the vicinity of the lower end of the transition temperature range used in step S31 to be the first transition temperature, and without stopping the rotation of the rotating bodies of the fixer 5, sets the regulated temperature on the heater side to the first transition temperature (step S33). In variation 2, the controller 6 causes the rotating bodies of the fixer 5 to rotate at the linear speed of 45 mm/s, and sets the regulated temperature on the heater side to 150° C. that is in the vicinity of the lower end of the transition temperature range. For example, when the regulated temperature in the fixing state is 145° C., the regulated temperature on the heater side is set to be 150° C.

(14) The controller 6 waits until the temperature of the rotating bodies on the heater side reaches the vicinity of the temperature obtained by deducting the constant temperature from the fixing temperature in step S31 (step S34).

(15) The controller 6 waits until a predetermined time period, corresponding to an amount of time for the temperature of the rotating bodies on the heater side to stabilize, has passed (step S35).

In variation 2, the controller 6 waits until either the temperature is within 5° C. of the temperature obtained by deducting 20° C. from the fixing temperature, or 10 seconds have passed, whichever condition is fulfilled first. For example, when set to perform normal printing on normal paper, since the fixing temperature is 185° C., the controller 6 waits until the temperature reaches a temperature within 5° C.

of 165° C., which is 20° C. lower than 185° C., or until 10 seconds have passed, whichever condition is fulfilled first. Also, for example, when set to perform normal printing on high-gloss paper, since the fixing temperature is 145° C., the controller 6 waits until the temperature reaches a temperature within 5° C. of 125° C., which is 20° C. lower than 145° C., or until 10 seconds have passed, whichever condition is fulfilled first. Since at this time, the regulated temperature is 15° C., and when the temperature is raised from 145° C. to 150° C., the temperature does not reach a temperature within 5° C. of 125° C., 10 seconds pass.

(16) An instruction to print is received while waiting for either the temperature of the rotating bodies on the heater side to be in the vicinity of the temperature obtained by deducting the constant temperature from the fixing temperature, or for the predetermined time period to pass (step S34:NO, step S35:NO, step S36).

(17) When the temperature of the rotating bodies on the heater side reaches the vicinity of the temperature obtained by deducting the constant temperature from the fixing temperature (step S34:YES), or when the predetermined time period has passed (step S35:YES), the controller 6 calculates the second transition temperature that is one of the regulated temperatures in the transition state. First, the controller 6 judges whether the temperature obtained by deducting the constant temperature from the fixing temperature is higher than the predetermined temperature that is in the vicinity of the lower end of the transition temperature range (step S37).

In variation 2, the controller 6 judges whether the temperature obtained by deducting, for example, 15° C. from the regulated temperature in the fixing state is higher than, for example, 150° C. in the vicinity of the lower end of the transition temperature range. For example, when the regulated temperature in the fixing state is 185° C., since the temperature obtained by deducting 15° C. is 170° C., a judgment is made that the temperature is higher than 150° C., and when the regulated temperature in the fixing state is 145° C., since the temperature obtained by deducting 15° C. is 130° C., a judgment is made that the temperature is lower than 150° C.

(18) When a judgment is made that the temperature is higher (step S37:YES), the temperature obtained by deducting the constant temperature from the fixing temperature used in step S37 is determined to be the second transition temperature, the rotation of the rotating bodies of the fixer 5 is stopped, the regulated temperature on the pressure application side is set to the standby temperature, and the regulated temperature on the heater side is set to the second transition temperature (step S38). In variation 2, the controller 6 stops the rotation of the rotating bodies of the fixer 5, and sets the regulated temperature on the heater side to the temperature obtained by deducting 15° C. from the regulated temperature in the fixing state. For example, when the regulated temperature in the fixing state is 185° C., the regulated temperature on the heater side is set to 170° C.

(19) When a judgment is made that the temperature is not higher (step S37:NO), the controller 6 determines that the predetermined temperature in the vicinity of the lower end of the transition temperature range used in step S37 is the second transition temperature, stops the rotation of the rotating bodies of the fixer 5, sets the regulated temperature on the pressure application side to the standby temperature, and sets the regulated temperature on the heater side to the second transition temperature (step S39). In variation 2, the controller 6 stops the rotation of the rotating bodies of the fixer 5, and sets the regulated temperature on the heater side to 150° C., which is in the vicinity of the lower end of the transition temperature range. For example, when the regulated temperature in the fixing state is 145° C., the controller 6 sets the regulated temperature on the heater side to 150° C.

In (20) to (22), similar processing to (16) to (18) in FIG. 5 in embodiment 1 is performed (steps S16 to S18).

Additional Remarks

As described above, according to variation 2, in the transition state immediately after fixing has finished, when the fixing temperature is comparatively high, the regulated temperature in the transition state is set to the temperature obtained by deducting the constant temperature from the fixing temperature. Therefore, control can be performed so that the temperature of the rotating bodies is regulated according to the fixing temperature, and so that the temperature does not become too high and does not become unnecessarily low. In addition, when the fixing temperature is comparatively low, control can be performed so that the temperature of the rotating bodies does not become less than or equal to the predetermined temperature, since the regulated temperature in the transition state is set to the predetermined temperature in the vicinity of the lower end of the transition temperature range.

Note that provided that the first and second transition temperatures respectively fulfill the above-described conditions, the first and second transition temperatures may both be the same temperature, or may be different temperatures.

Also, in the transition state, waiting for the predetermined time period to pass after stopping the rotation of the rotating bodies is not necessarily required. Specifically, an effect similar to the above-described effect can be achieved even when, in the transition state, after setting the regulated temperature in the transition temperature range while the rotating bodies are rotating, the rotation of the rotating bodies is stopped, the regulated temperature is raised to the standby temperature, and a transition is made to the standby state.

Variation 3

In variation 3, similarly to variation 2, the regulated temperature is calculated appropriately as needed. Specifically, the regulated temperature is calculated based on a relationship between a fixing temperature that changes according to conditions and a temperature that results in an error as an abnormally low temperature.

Figure 10:
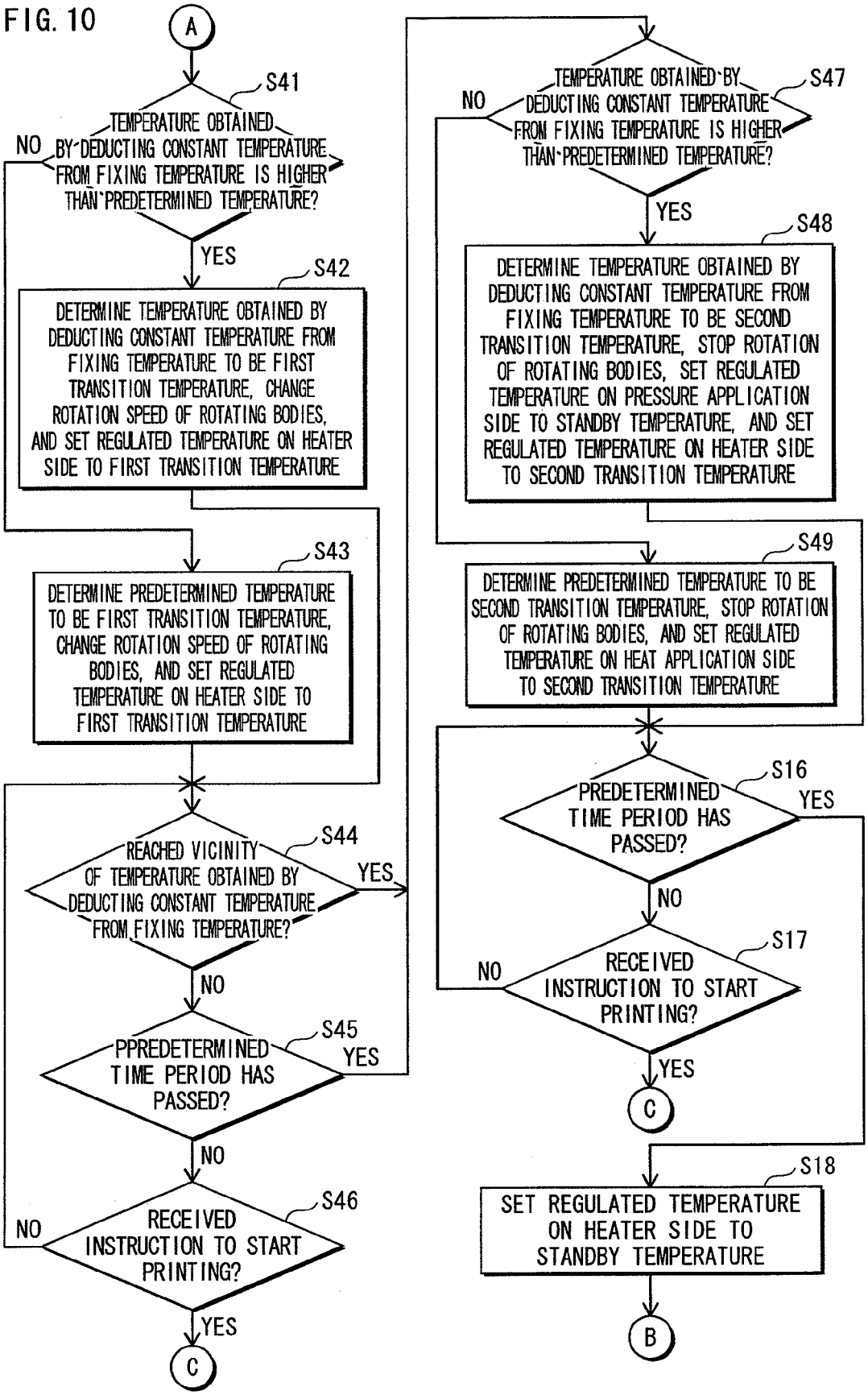
FIG. 10 shows a procedure for processing to appropriately control the temperature of the rotating bodies of the fixer 5 according to variation 3.

The following describes, with reference to FIGS. 4, 5, and 10, a procedure of processing for the controller 6 to appropriately control the temperature of the rotating bodies of the fixer 5.

Note that the steps in which processing is performed similarly to the procedure in FIGS. 4 and 5 in embodiment 1 are referred to by same numbers, and description thereof is omitted.

In (1) to (10), similar processing to (1) to (10) in FIG. 4 in embodiment 1 is performed (steps S1 to S10).

(11) When the last sheet has passed through the nip (step S10:YES), the controller 6 starts calculating the first transition temperature that is one of the regulated temperatures in the transition state. First, a judgment is made as to whether the temperature obtained by deducting the constant temperature from the fixing temperature is higher than a predetermined temperature that is higher than a temperature in the vicinity of a temperature that results in an error as an abnormally low temperature (step S41). In variation 3, a judgment is made as to whether the temperature obtained by deducting, for example, 20° C. from the regulated temperature in the fixing state, is higher than, for example, 135° C. that is in the vicinity of the temperature that results in an error as an abnormally low temperature. For example, when the regulated temperature in the fixing state is 185° C., since the temperature obtained by deducting 20° C. is 165° C., a judgment is made that the temperature is higher than 135° C., and when the regulated temperature in the fixing state is 145° C., since the temperature obtained by deducting 20° C. is 125° C., a judgment is made that the temperature is lower than 135° C.

(12) If a judgment is made that the temperature is higher (step S41:YES), the temperature obtained by deducting the constant temperature from the fixing temperature is determined to be the first transition temperature, and without stopping the rotation of the rotating bodies of the fixer 5, the controller 6 sets the regulated temperature on the heater side to the first transition temperature (step S42). In variation 3, the controller 6 causes the rotating bodies of the fixer 5 to rotate at the linear speed of 45 mm/s, and sets the regulated temperature on the heater side to the temperature obtained by deducting 20° C. from the regulated temperature in the fixing state. For example, when the regulated temperature in the fixing state is 185° C., the regulated temperature on the heater side is set to 165° C.

(13) When a judgment is made that the temperature is not higher (step S41:NO), the controller 6 determines the predetermined temperature in the vicinity of the temperature that results in an error as an abnormally low temperature used in step S41 to be the first transition temperature, and without stopping the rotation of the rotating bodies of the fixer 5, sets the regulated temperature on the heater side to the first transition temperature (step S43). In variation 3, the controller 6 causes the rotating bodies of the fixer 5 to rotate at the linear speed of 45 mm/s, and sets the regulated temperature on the heater side to 135° C. that is in the vicinity of the temperature that results in an error as an abnormally low temperature. For example, when the regulated temperature in the fixing state is 145° C., the regulated temperature on the heater side is set to be 135° C.

(14) The controller 6 waits until the temperature of the rotating bodies on the heater side reaches the vicinity of the temperature obtained by deducting the constant temperature from the fixing temperature in step S41 (step S44).

(15) The controller 6 waits until a predetermined time period, corresponding to an amount of time for the temperature of the rotating bodies on the heater side to stabilize, has passed (step S45).

In variation 3, the controller 6 waits until either the temperature reaches a temperature that is within 5° C. of a temperature 20° C. lower than the fixing temperature, or 10 seconds have passed, whichever condition is fulfilled first. For example, when set to perform normal printing on normal paper, since the fixing temperature is 185° C., the controller 6 waits until the temperature reaches a temperature within 5° C. of 165° C., which is 20° C. lower than 185° C., or until 10 seconds have passed, whichever condition is fulfilled first. Also, for example, when set to perform high-gloss printing on normal paper, since the fixing temperature is 145° C., the controller 6 waits until the temperature reaches a temperature within 5° C. of 125° C., which is 20° C. lower than 145° C., or until 10 seconds have passed, whichever condition is fulfilled first. Since at this time, the regulated temperature is 135° C., and when the temperature is lowered from 145° C. to 135° C., the temperature does not reach a temperature within 5° C. of 125° C., 10 seconds pass.

(16) An instruction to print is received while waiting for either the temperature of the rotating bodies on the heater side to be in the vicinity of the temperature obtained by deducting the constant temperature from the fixing temperature, or for the predetermined time period to pass (step S44:NO, step S45:NO, step S46).

(17) When the temperature of the rotating bodies on the heater side is in the vicinity of the temperature obtained by deducting the constant temperature from the fixing temperature (step S44:YES), or when the predetermined time period has passed (step S45:YES), the controller 6 calculates the second transition temperature that is one of the regulated temperatures in the transition state. First, the controller 6 judges whether the temperature obtained by deducting the constant temperature from the fixing temperature is higher than the predetermined temperature that is in the vicinity of and is higher than the temperature that results in an error as an abnormally low temperature (step S47).

In variation 3, the controller 6 judges whether the temperature obtained by deducting, for example, 15° C. from the regulated temperature in the fixing state is higher than, for example, 140° C. in the vicinity of the temperature that results in an error as an abnormally low temperature. For example, when the regulated temperature in the fixing state is 185° C., since the temperature obtained by deducting 15° C. is 170° C., a judgment is made that the temperature is higher than 140° C., and when the regulated temperature in the fixing state is 145° C., since the temperature obtained by deducting 15° C. is 130° C., a judgment is made that the temperature is lower than 140° C.

(18) When a judgment is made that the temperature is higher (step S47:YES), the temperature obtained by deducting the constant temperature from the fixing temperature used in step S47 is determined to be the second transition temperature, the rotation of the rotating bodies of the fixer 5 is stopped, the regulated temperature on the pressure application side is set to the standby temperature, and the regulated temperature on the heater side is set to the second transition temperature (step S48). In variation 3, the controller 6 stops the rotation of the rotating bodies of the fixer 5, and sets the regulated temperature on the heater side to the temperature obtained by deducting 15° C. from the regulated temperature in the fixing state. For example, when the regulated temperature in the fixing state is 185° C., the regulated temperature on the heater side is set to 170° C.

(19) When a judgment is made that the temperature is not higher (step S47:NO), the controller 6 determines that the predetermined temperature in the vicinity of the temperature that results in an error as an abnormally low temperature used in step S47 is the second transition temperature, stops the rotation of the rotating bodies of the fixer 5, sets the regulated temperature on the pressure application side to the standby temperature, and sets the regulated temperature on the heater side to the second transition temperature (step S49). In variation 3, the controller 6 stops the rotation of the rotating bodies of the fixer 5, and sets the regulated temperature on the heater side to 140° C., which is in the vicinity of the temperature that results in an error as an abnormally low temperature. For example, when the regulated temperature in the fixing state is 145° C., the controller 6 sets the regulated temperature on the heater side to 140° C.

In (20) to (22), similar processing to (16) to (18) in FIG. 5 in embodiment 1 is performed (steps S16 to S18).

Additional Remarks

As described above, according to variation 3, in the transition state immediately after fixing has finished, when the fixing temperature is comparatively high, the regulated temperature in the transition state is set to the temperature obtained by deducting the constant temperature from the fixing temperature. Therefore, control can be performed so that the temperature of the rotating bodies is regulated according to the fixing temperature, and so that the temperature and does not become unnecessarily low. In addition, when the fixing temperature is comparatively low, control can be performed so that the temperature of the rotating bodies does not become less than or equal to the predetermined temperature, since the regulated temperature in the transition state is set to the predetermined temperature in the vicinity of, and is higher than, the temperature that results in an error as an abnormally low temperature.

Note that provided that the first and second transition temperatures respectively fulfill the above-described conditions, the first and second transition temperatures may both be the same temperature, or may be different temperatures.

Also, in the transition state, waiting for the predetermined time period to pass after stopping the rotation of the rotating bodies is not necessarily required. Specifically, an effect similar to the above-described effect can be achieved even when, in the transition state, after setting the regulated temperature in the transition temperature range while the rotating bodies are rotating, the rotation of the rotating bodies is stopped, the regulated temperature is raised to the standby temperature, and a transition is made to the standby state.

Variations 4 and 5

In contrast to the fact that in variations 2 and 3, when causing the rotation of the rotating bodies to stop in the transition state, the controller 6 waits for either the temperature of the rotating bodies on the heater side to reach the vicinity of the temperature obtained by deducting the constant temperature from the fixing temperature, or a predetermined time period, corresponding to an amount of time for the temperature of the rotating bodies on the heater side to stabilize, to pass, in variations 4 and 5, after the temperature of the rotating bodies reaches the regulated temperature, the controller 6 waits for the predetermined time to pass.

First, variation 4, which corresponds to variation 2, is described below.

Figure 11:
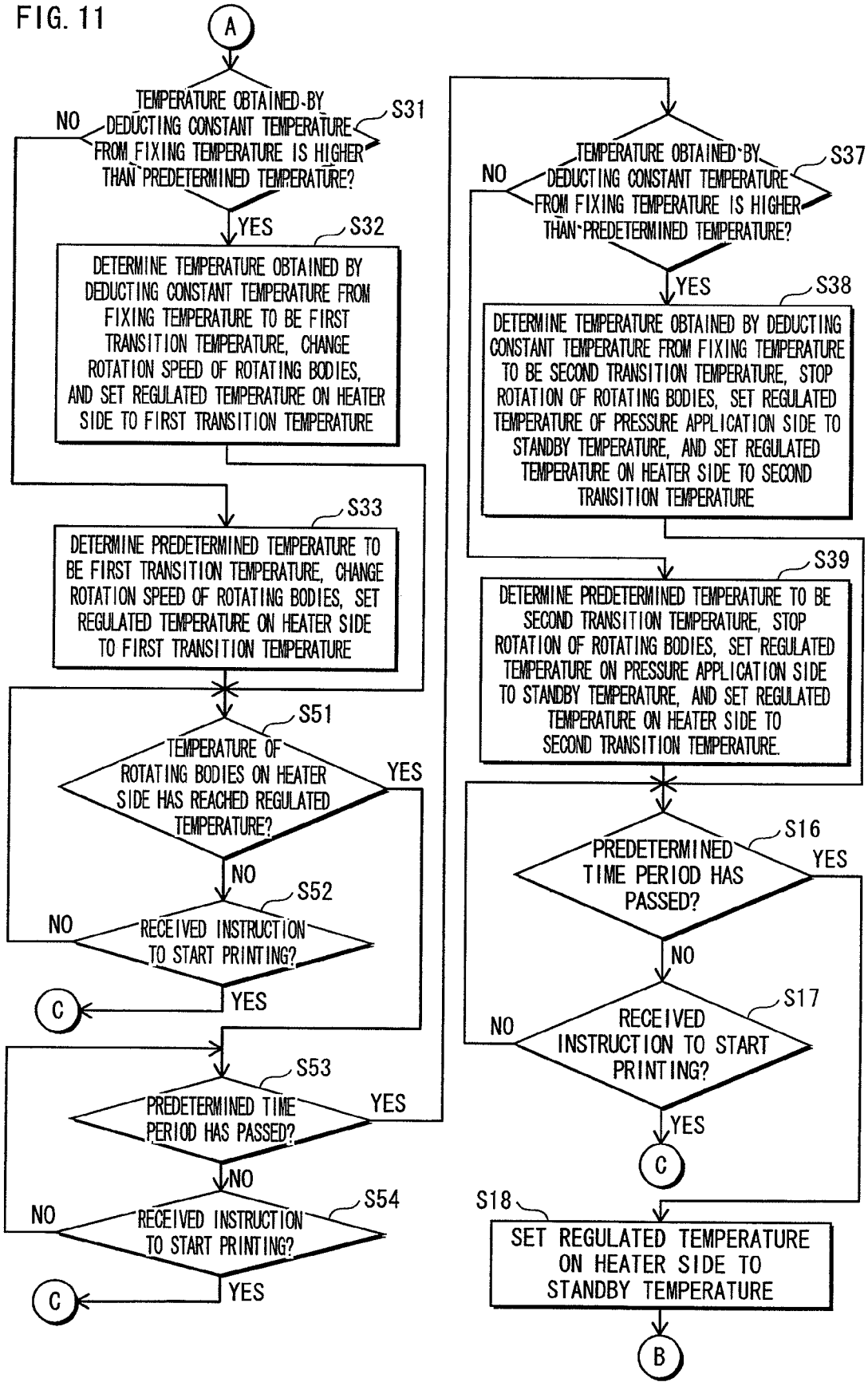
FIG. 11 shows a procedure for processing to appropriately control the temperature of the rotating bodies of the fixer 5 according to variation 4.

The procedure of processing by which the controller 6 appropriately controls the temperature of the rotating bodies of the fixer 5 is described below with reference to FIGS. 4, 5, and 11.

Note that the steps in which processing is performed similarly to the procedure in FIGS. 4, 5, and 9 in variation 2 are referred to by same numbers, and description thereof is omitted.

In (1) to (13), similar processing to (1) to (13) in FIGS. 4 and 9 in variation 2 is performed (steps S1 to S10, steps 31 to S33).

(14) The controller 6 waits for the temperature of the rotating bodies on the heater side to reach the regulated temperature (step S51).

In variation 4, for example when set to normal printing on normal paper, since the fixing temperature is 185° C., the controller 6 waits until the temperature of the rotating bodies on the heater side reaches 165° C. that is the regulated temperature at this time. Also, for example when set to high-gloss printing on normal paper, the controller 6 waits for the temperature of the rotating bodies on the heater side to reach 145° C., which is the regulated temperature at this time.

(15) An instruction to start printing is received while waiting for the temperature of the rotating bodies on the heater side to reach the regulated temperature (step S51:NO, step S52).

(16) When the temperature of the rotating bodies on the heater side reaches the regulated temperature (step S51: YES), the controller 6 waits a predetermined time period, corresponding to an amount of time for the rotating bodies on the heater side to stabilize, to pass (step S53).

(17) An instruction to start printing is received while waiting for the predetermined time period to pass (step S53:NO, step S54).

(18) When the predetermined time period has passed (step S53:YES), the same processing is performed as (17) in FIG. 9 of variation 2 (step S37).

In (19) to (23), similar processing is performed to (18) to (22) of FIG. 9 in variation 2 (steps S37 to S39, S16 to S18).

Next, variation 5, which corresponds to variation 3, is described below.

Figure 12:
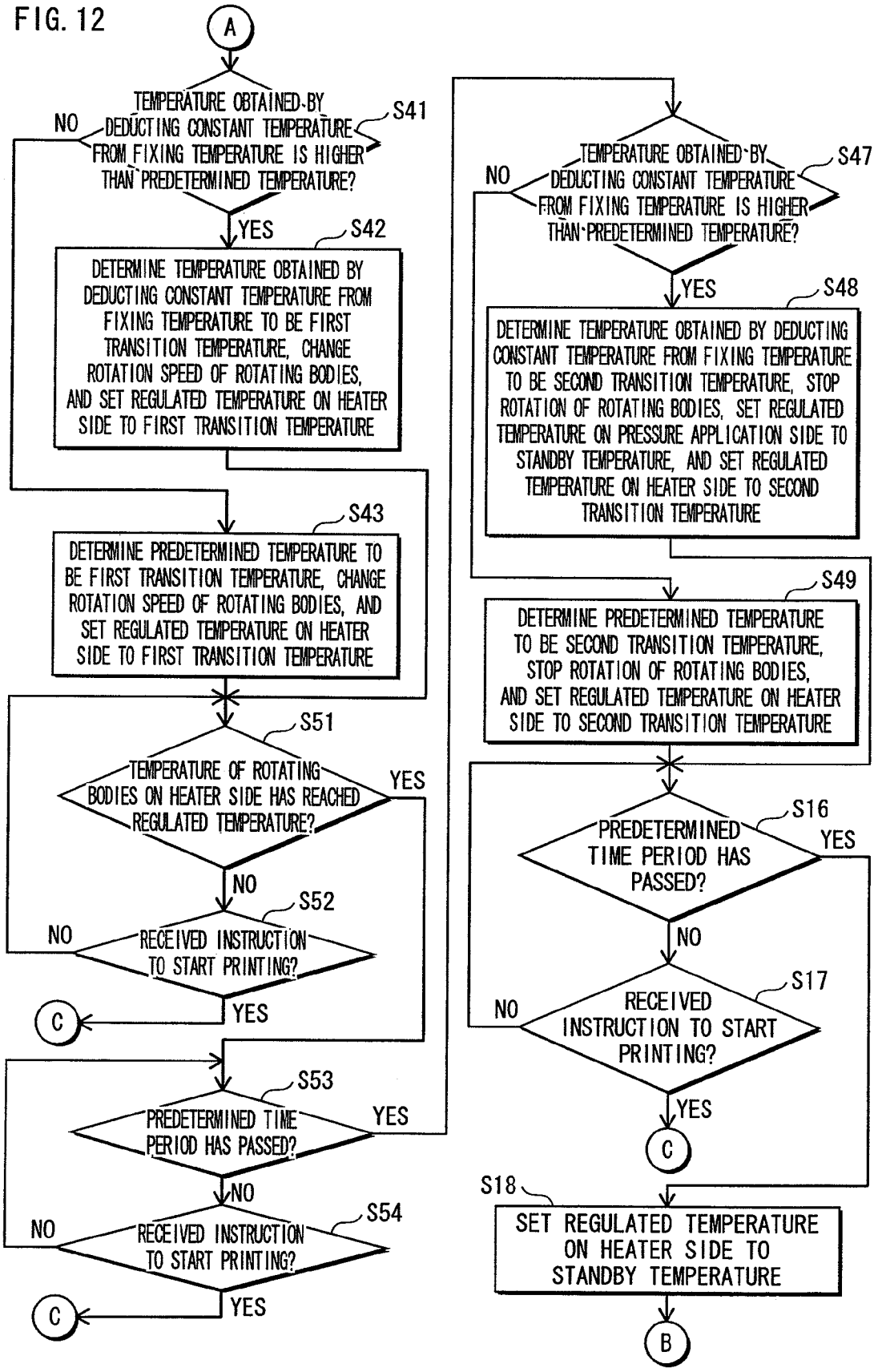
FIG. 12 shows a procedure for processing to appropriately control the temperature of the rotating bodies of the fixer 5 according to variation 5.

The procedure of processing by which the controller 6 appropriately controls the temperature of the rotating bodies of the fixer 5 is described below with reference to FIGS. 4, 5, and 12.

Note that the steps in which processing is performed similarly to the procedure in FIGS. 4, 5 and 10 in variation 3 are referred to by same numbers, and description thereof is omitted.

In (1) to (13), similar processing to (1) to (13) in FIGS. 4 and 10 in variation 3 is performed (steps S1 to S10, steps 41 to S43).

(14) The controller 6 waits for the temperature of the rotating bodies on the heater side to reach the regulated temperature (step S51).

In variation 5, for example when set to perform normal printing on normal paper, since the fixing temperature is 185° C., the controller 6 waits until the temperature of the rotating bodies on the heater side reaches 165° C. that is the regulated temperature at this time. Also, for example when set to perform high-gloss printing on normal paper, the controller 6 waits for the temperature of the rotating bodies on the heater side to reach 135° C., which is the regulated temperature at this time.

(15) An instruction to start printing is received while waiting for the temperature of the rotating bodies on the heater side to reach the regulated temperature (step S51:NO, step S52).

(16) When the temperature of the rotating bodies on the heater side reaches the regulated temperature (step S51: YES), the controller 6 waits a predetermined time period, corresponding to an amount of time for the rotating bodies on the heater side to stabilize, to pass (step S53).

(17) An instruction to start printing is received while waiting for the predetermined time period to pass (step S53:NO, step S54).

(18) When the predetermined time period has passed (step S53:YES), the same processing is performed as (17) in FIG. 10 of variation 3 (step S47).

In (19) to (23), similar processing is performed to (18) to (22) of FIGS. 5 and 10 in variation 3 (steps S47 to S49, S16 to S18).

Additional Remarks

Since according to variations 4 and 5, as described above, the controller 6 causes the rotating bodies to stop after either a predetermined time period has passed since the temperature of the rotating bodies reached the regulated temperature, or the rotating bodies to rotate a predetermined number of times after the temperature of the rotating bodies has reached the regulated temperature, due to the fact that an actual measurement is made of the temperature of the rotating bodies, the image formation apparatus is less readily influenced by environmental differences.

Note that when a program for causing the operations of the present embodiments 1 and 2 to be executed on a computer is recorded on a computer-readable recording medium and distributed, this recording medium can become a focus of business transactions. Also, the program can become the focus of the business transactions via a network, etc., and can be presented to a user by being displayed on a display apparatus or printed out.

Here, there are no particular limitations as to the type of removable recording medium, and for example, a removable recording medium such as a floppy disk, CD, MO, DVD, or memory card, or a fixed recording medium such as a semiconductor memory, etc. may be used.

Additional Remarks on the Embodiments

The above-described image formation apparatus may include a structure in which the fixing controller may, prior to performing temperature control to reach the standby temperature, cause the pair of rotating bodies to rotate, and after performing temperature control so that the temperature of the at least one of the rotating bodies reaches the transition temperature range, stop the pair of rotating bodies, and perform temperature control so that the temperature of the at least one of the rotating bodies reaches a lower temperature than the standby temperature.

According to this structure, prior to performing temperature control to reach the standby temperature, the rotating bodies in the fixer 5 are stopped in the standby state, temperature regulation is performed so that the temperature reaches a lower temperature than the standby temperature, and thereafter temperature regulation is performed so that the standby temperature is reached. Therefore, while regulating the temperature to be lower than the standby temperature, after a temperature elevation due to stopping the rotation of the rotating bodies has subsided, setting a regulated temperature to a standby temperature is possible. Also, even when the regulated temperature in standby is set to a high temperature, this structure enables reducing the length of time that heat is continuously applied to the rotating bodies, reducing the amount of overshoot, and alleviating the negative influence of overshoot.

Alternatively, the above-described image formation apparatus may be constituted from the following constituent elements: a detector operable to detect a temperature of the at least one of the rotating bodies, wherein the fixing controller, if the detected temperature at a time of the judgment by the judgment part to transition to the standby state is lower than a predetermined temperature in the transition temperature range, may perform temperature control so that the temperature of the at least one of the rotating bodies reaches a temperature that is greater than or equal to the predetermined temperature.

According to this structure, particularly when the temperature of the rotating bodies is a lower temperature than the predetermined temperature in the transition temperature range, by setting the regulated temperature to greater than or equal to the predetermined temperature, since the temperature of the rotating bodies is actively raised, this enables reducing the amount of time spent waiting for printing to start, and also shortening the amount of time until the standby state stabilizes.

Alternatively, the above-described image formation apparatus may include a structure in which the fixing controller may compare (a) a temperature obtained by deducting a constant temperature from the fixing temperature to (b) a predetermined temperature in a vicinity of a lower end of the transition temperature range, thus determining a higher temperature that is a higher one of the two compared temperatures, and perform temperature control so that the temperature of the at least one of the rotating bodies reaches the higher temperature determined as a result of the comparison.

According to this structure, when transitioning to the standby state, when the fixing temperature is comparatively high, the regulated temperature in the transition state is set to the temperature obtained by deducting the constant temperature from the fixing temperature. Therefore, control can be performed so that the temperature of the rotating bodies is regulated according to the fixing temperature, and so that the temperature does not become unnecessarily low. In addition, when the fixing temperature is comparatively low, control can be performed so that the temperature of the rotating bodies does not become less than or equal to the predetermined temperature, since the regulated temperature in the transition state is set to the predetermined temperature in the vicinity of, and is higher than, the temperature that results in an error as an abnormally low temperature.

The above-described image formation apparatus may include a structure in which the fixing controller may, prior to performing temperature control to reach the standby temperature, cause the pair of rotating bodies to rotate, and after performing temperature control so that the temperature of the at least one of the rotating bodies reaches the higher temperature, stop the pair of rotating bodies, compare (a) a temperature obtained by deducting a constant temperature that is equal to or different from the constant temperature from the fixing temperature to (b) a predetermined temperature in the vicinity of the lower end of the transition temperature range that is equal to or different from the predetermined temperature, thus newly determining a higher temperature, and perform temperature control so that the temperature of the at least one of the rotating bodies reaches the newly determined higher temperature.

According to this structure, before performing control to reach the standby state, the rotating bodies in the fixer 5 are stopped in the transition state. When the fixing temperature is comparatively high, the temperature is regulated to be the temperature obtained by deducting the constant temperature from the fixing temperature, and when the fixing temperature is comparatively low, the temperature is regulated to be a predetermined temperature in the vicinity of the lower end of the transition temperature range. Therefore, this structure enables, while performing temperature regulation in accordance with the fixing temperature, setting a regulated temperature to the standby temperature after a temperature elevation due to stopping the rotation of the rotating bodies has subsided and stabilized, and even when the regulated temperature in standby is a high temperature, since the time period of continuously applying heat at one time is short, an amount of overshoot is small, and alleviating the negative influence of overshoot is possible.

The above-described image formation apparatus may include a structure in which the fixing controller may compare (a) a temperature obtained by deducting a constant temperature from the fixing temperature to (b) a predetermined temperature that is in a vicinity of, and is higher than a temperature that results in an error as an abnormally low temperature, thus determining a higher temperature that is a higher one of the two compared temperatures, and perform temperature control so that the temperature of the at least one of the rotating bodies reaches the higher temperature determined as a result of the comparison.

According to this structure, to make a transition to the standby state when the fixing temperature is comparatively high, the regulated temperature in the transition state is set to the temperature obtained by deducting the constant temperature from the fixing temperature. Therefore, control can be performed so that the temperature of the rotating bodies is regulated according to the fixing temperature, and so that the temperature does not become unnecessarily low. In addition, when the fixing temperature is comparatively low, control can be performed so that the temperature of the rotating bodies does not become less than or equal to the predetermined temperature, since the regulated temperature in the transition state is a predetermined temperature in a vicinity of and is higher than a temperature that results in an error as an abnormally low temperature.

The above-described image formation apparatus may include a structure in which the fixing controller may, prior to performing temperature control to reach the standby temperature, cause the pair of rotating bodies to rotate, and after performing temperature control so that the temperature of the at least one of the rotating bodies reaches the higher temperature, stop the pair of rotating bodies, compare (a) a temperature obtained by deducting a constant temperature that is equal to or different from the constant temperature from the fixing temperature to (b) a predetermined temperature that is equal to or different from the predetermined temperature, and that is in a vicinity of, and is higher than a temperature that results in an error as an abnormally low temperature, thus newly determining a higher temperature, and perform temperature control so that the temperature of the at least one of the rotating bodies reaches the newly determined higher temperature.

According to this structure, before performing control to reach the standby state, the rotating bodies in the fixer 5 are stopped in the transition state. When the fixing temperature is comparatively high, temperature regulation is performed to reach the temperature obtained by deducting the constant temperature from the fixing temperature, and when the fixing temperature is comparatively low, temperature regulation is performed to reach a predetermined temperature in the vicinity of the temperature that results in an error as an abnormally low temperature. Therefore, this structure enables, while performing temperature regulation in accordance with the fixing temperature, setting a regulated temperature to the standby temperature after a temperature elevation due to stopping the rotation of the rotating bodies has subsided and stabilized, and even when the regulated temperature in standby is a high temperature, since the time period of continuously applying heat at one time is short, an amount of overshoot is small, and alleviating the negative influence of overshoot is possible.

Alternatively, the above-described image formation apparatus may be constituted from the following constituent elements: a detector operable to detect a temperature of the at least one of the rotating bodies; wherein the fixing controller may, prior to performing temperature control to reach the standby temperature, stop the pair of rotating bodies when (a) the temperature, detected by the detector, of the at least one of the rotating bodies reaches a vicinity of the temperature obtained by deducting the constant temperature from the fixing temperature, or (b) without reaching the temperature obtained by deducting the constant temperature from the fixing temperature, either (i) a predetermined amount of time passes, or (ii) either one of the pair of rotating bodies has rotated a predetermined number of times.

According to this structure, when the fixing temperature is comparatively high, the rotating bodies are stopped after the temperature has fallen to the vicinity of the temperature obtained by deducting the constant temperature from the fixing temperature. Therefore, this enables quickly causing the rotating bodies to stop in accordance with the fixing temperature. When the fixing temperature is comparatively low, the temperature rises. Therefore, it is possible to cause the rotating bodies to stop after waiting until either a predetermined time period has passed, or the rotating bodies have rotated a predetermined number of times.

Alternatively, the above-described image formation apparatus may be constituted from the following constituent elements: a detector operable to detect a temperature of the at least one of the rotating bodies; wherein the fixing controller may, prior to performing temperature control to reach the standby temperature, stop the pair of rotating bodies when, after the temperature, detected by the detector, of the at least one of the rotating bodies reaches the standby temperature, (a) a predetermined amount of time passes, or (b) either one of the pair of rotating bodies has rotated a predetermined number of times.

According to this structure, it is possible to cause the rotating bodies to stop after waiting for either a predetermined time period to pass after the temperature of the rotating bodies have reached a set regulated temperature, or the rotating bodies have rotated a predetermined number of times after having reached the set regulated temperature. Therefore, this structure is not readily influenced by environmental variations, since the actual temperature of the rotating bodies is measured.

The above-described image formation apparatus may include a structure in which the standby temperature may be in a vicinity of an upper limit of a highest temperature that is permissible as a fixing temperature.

According to this structure, in standby, the temperature is regulated to reach a vicinity of the highest fixing temperature that can be set. Therefore, this structure enables reducing the waiting time until printing starts, even when the fixing temperature is high.

Also, the present invention may be an image formation method including a structure in which, in the fixing control step, prior to performing temperature control to reach the standby temperature, the pair of rotating bodies may be caused to rotate, and after performing temperature control so that the temperature of the at least one of the rotating bodies reaches the transition temperature range, the pair of rotating bodies may be stopped, and temperature control may be performed so that the temperature of the at least one of the rotating bodies reaches a lower temperature than the standby temperature. Here, the image formation method may further include a detecting step of detecting a temperature of the at least one of the rotating bodies, wherein in the fixing control step, if the detected temperature at a time of the judgment by the judgment part to transition to the standby state is lower than a predetermined temperature in the transition temperature range, temperature control may be performed so that the temperature of the at least one of the rotating bodies reaches a temperature that is greater than or equal to the predetermined temperature, and in the in the fixing control step, (a) a temperature obtained by deducting a constant temperature from the fixing temperature may be compared to (b) a predetermined temperature in a vicinity of a lower end of the transition temperature range, thus determining a higher temperature that is a higher one of the two compared temperatures, and temperature control may be performed so that the temperature of the at least one of the rotating bodies reaches the higher temperature determined as a result of the comparison. Also, the image formation method may be such that in the fixing control step, prior to performing temperature control to reach the standby temperature, the pair of rotating bodies are caused to rotate, and after performing temperature control so that the temperature of the at least one of the rotating bodies reaches the higher temperature, the pair of rotating bodies are stopped, (a) a temperature obtained by deducting a constant temperature that is equal to or different from the constant temperature from the fixing temperature, is compared to (b) a predetermined temperature in the vicinity of the lower end of the transition temperature range that is equal to or different from the predetermined temperature, thus newly determining a higher temperature, and temperature control is performed so that the temperature of the at least one of the rotating bodies reaches the newly determined higher temperature, may be such that in the fixing control step, (a) a temperature obtained by deducting a constant temperature from the fixing temperature is compared to (b) a predetermined temperature that is in a vicinity of, and is higher than a temperature that results in an error as an abnormally low temperature, thus determining a higher temperature that is a higher one of the two compared temperatures, and temperature control is performed so that the temperature of the at least one of the rotating bodies reaches the higher temperature determined as a result of the comparison, and may be such that in the fixing control step, prior to performing temperature control to reach the standby temperature, the pair of rotating bodies are caused to rotate, and after performing temperature control so that the temperature of the at least one of the rotating bodies reaches the higher temperature, the pair of rotating bodies are stopped, and (a) a temperature obtained by deducting a constant temperature that is equal to or different from the constant temperature from the fixing temperature, is compared to (b) a predetermined temperature that is equal to or different from the predetermined temperature, and that is in a vicinity of, and is higher than a temperature that results in an error as an abnormally low temperature, thus newly determining a higher temperature, and temperature control is performed so that the temperature of the at least one of the rotating bodies reaches the newly determined higher temperature. Furthermore, similar effects of the above-described image formation apparatus can also be achieved by the image formation method, which may also be a method including a detecting step of detecting a temperature of the at least one of the rotating bodies; wherein in the fixing control step, prior to performing temperature control to reach the standby temperature, the pair of rotating bodies may be stopped when (a) the temperature, detected by the detector, of the at least one of the rotating bodies reaches a vicinity of the temperature obtained by deducting the constant temperature from the fixing temperature, or (b) without reaching the temperature obtained by deducting the constant temperature from the fixing temperature, either (i) a predetermined amount of time passes, or (ii) either one of the pair of rotating bodies has rotated a predetermined number of times, a method further including a detecting step of detecting a temperature of the at least one of the rotating bodies; wherein in the fixing control step, prior to performing temperature control to reach the standby temperature, the pair of rotating bodies is stopped when, after the temperature, detected by the detector, of the at least one of the rotating bodies reaches the standby temperature, (a) a predetermined amount of time passes, or (b) either one of the pair of rotating bodies has rotated a predetermined number of times, and may also be a method in which the standby temperature is in a vicinity of an upper limit of a highest temperature that is permissible as a fixing temperature.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image formation apparatus that forms an image by causing a recording sheet on which an unfixed image has been formed to pass through a fixing nip between a pair of rotating bodies, at least one of which is a heat rotating body, comprising:

a judgment part operable to judge whether to transition from a fixing state to a standby state, the standby state being a state in which the pair of rotating bodies stops rotating and temperature control is performed so that at least one of the rotating bodies reaches a predetermined standby temperature, and the fixing state being a state in which the pair of rotating bodies are rotating, and temperature control is performed so that the at least one of the rotating bodies reaches a fixing temperature that changes in accordance with a setting; and a fixing controller operable to, upon a judgment by the judgment part to transition to the standby state, prior to performing temperature control to reach the standby temperature, cause the pair of rotating bodies to rotate, and perform temperature control so that the temperature of the at least one of the rotating bodies reaches a predetermined transition temperature range including temperatures higher than a lower limit of a temperature that is permissible as the fixing temperature, and lower than an upper limit of a temperature that is permissible as the fixing temperature.

2. The image formation apparatus of claim 1, wherein the fixing controller, prior to performing temperature control to reach the standby temperature, causes the pair of rotating bodies to rotate, and after performing temperature control so that the temperature of the at least one of the rotating bodies reaches the transition temperature range, stops the pair of rotating bodies, and performs temperature control so that the temperature of the at least one of the rotating bodies reaches a lower temperature than the standby temperature.

3. The image formation apparatus of claim 1, further comprising:

a detector operable to detect a temperature of the at least one of the rotating bodies, wherein the fixing controller, if the detected temperature at a time of the judgment by the judgment part to transition to the standby state is lower than a predetermined temperature in the transition temperature range, performs temperature control so that the temperature of the at least one of the rotating bodies reaches a temperature that is greater than or equal to the predetermined temperature.

4. The image formation apparatus of claim 1, wherein the fixing controller compares (a) a temperature obtained by deducting a constant temperature from the fixing temperature to (b) a predetermined temperature in a vicinity of a lower end of the transition temperature range, thus determining a higher temperature that is a higher one of the two compared temperatures, and performs temperature control so that the temperature of the at least one of the rotating bodies reaches the higher temperature determined as a result of the comparison.

5. The image formation apparatus of claim 4, wherein the fixing controller, prior to performing temperature control to reach the standby temperature, causes the pair of rotating bodies to rotate, and after performing temperature control so that the temperature of the at least one of the rotating bodies reaches the higher temperature, stops the pair of rotating bodies, compares (a) a temperature obtained by deducting a constant temperature that is equal to or different from the constant temperature from the fixing temperature to (b) a predetermined temperature in the vicinity of the lower end of the transition temperature range that is equal to or different from the predetermined temperature, thus newly determining a higher temperature, and performs temperature control so that the temperature of the at least one of the rotating bodies reaches the newly determined higher temperature.

6. The image formation apparatus of claim 4, further comprising:

a detector operable to detect a temperature of the at least one of the rotating bodies; wherein the fixing controller, prior to performing temperature control to reach the standby temperature, stops the pair of rotating bodies when (a) the temperature, detected by the detector, of the at least one of the rotating bodies reaches a vicinity of the temperature obtained by deducting the constant temperature from the fixing temperature, or (b) without reaching the temperature obtained by deducting the constant temperature from the fixing temperature, either (i) a predetermined amount of time passes, or (ii) either one of the pair of rotating bodies has rotated a predetermined number of times.

7. The image formation apparatus of claim 4, further comprising:

a detector operable to detect a temperature of the at least one of the rotating bodies; wherein the fixing controller, prior to performing temperature control to reach the standby temperature, stops the pair of rotating bodies when, after the temperature, detected by the detector, of the at least one of the rotating bodies reaches the standby temperature, (a) a predetermined amount of time passes, or (b) either one of the pair of rotating bodies has rotated a predetermined number of times.

8. The image formation apparatus of claim 1, wherein the fixing controller compares (a) a temperature obtained by deducting a constant temperature from the fixing temperature to (b) a predetermined temperature that is in a vicinity of, and is higher than a temperature that results in an error as an abnormally low temperature, thus determining a higher temperature that is a higher one of the two compared temperatures, and performs temperature control so that the temperature of the at least one of the rotating bodies reaches the higher temperature determined as a result of the comparison.

9. The image formation apparatus of claim 8, wherein the fixing controller, prior to performing temperature control to reach the standby temperature, causes the pair of rotating bodies to rotate, and after performing temperature control so that the temperature of the at least one of the rotating bodies reaches the higher temperature, stops the pair of rotating bodies, compares (a) a temperature obtained by deducting a constant temperature that is equal to or different from the constant temperature from the fixing temperature to (b) a predetermined temperature that is equal to or different from the predetermined temperature, and that is in a vicinity of, and is higher than a temperature that results in an error as an abnormally low temperature, thus newly determining a higher temperature, and performs temperature control so that the temperature of the at least one of the rotating bodies reaches the newly determined higher temperature.

10. The image formation apparatus of claim 1, wherein the standby temperature is in a vicinity of an upper limit of a highest temperature that is permissible as a fixing temperature.

11. An image formation method in which an image is formed by causing a recording sheet on which an unfixed image has been formed to pass through a fixing nip between a pair of rotating bodies, at least one of which is a heat rotating body, comprising:

a judging step of judging whether to transition from a fixing state to a standby state, the standby state being a state in which the pair of rotating bodies stops rotating and temperature control is performed so that at least one of the rotating bodies reaches a predetermined standby temperature, and the fixing state being a state in which the pair of rotating bodies are rotating, and temperature control is performed so that the at least one of the rotating bodies reaches a fixing temperature that changes in accordance with a setting; and a fixing control step of, upon a judgment by the judgment part to transition to the standby state, prior to performing temperature control to reach the standby temperature, causing the pair of rotating bodies to rotate, and performing temperature control so that the temperature of the at least one of the rotating bodies reaches a predetermined transition temperature range including temperatures higher than a lower limit of a temperature that is permissible as the fixing temperature, and lower than an upper limit of a temperature that is permissible as the fixing temperature.

12. The image formation method of claim 11, wherein in the fixing control step, prior to performing temperature control to reach the standby temperature, the pair of rotating bodies are caused to rotate, and after performing temperature control so that the temperature of the at least one of the rotating bodies reaches the transition temperature range, the pair of rotating bodies are stopped, and temperature control is performed so that the temperature of the at least one of the rotating bodies reaches a lower temperature than the standby temperature.

13. The image formation method of claim 11, further comprising:

a detecting step of detecting a temperature of the at least one of the rotating bodies, wherein in the fixing control step, if the detected temperature at a time of the judgment by the judgment part to transition to the standby state is lower than a predetermined temperature in the transition temperature range, temperature control is performed so that the temperature of the at least one of the rotating bodies reaches a temperature that is greater than or equal to the predetermined temperature.

14. The image formation method of claim 11, wherein in the fixing control step, (a) a temperature obtained by deducting a constant temperature from the fixing temperature is compared to (b) a predetermined temperature in a vicinity of a lower end of the transition temperature range, thus determining a higher temperature that is a higher one of the two compared temperatures, and temperature control is performed so that the temperature of the at least one of the rotating bodies reaches the higher temperature determined as a result of the comparison.

15. The image formation method of claim 14, wherein in the fixing control step, prior to performing temperature control to reach the standby temperature, the pair of rotating bodies are caused to rotate, and after performing temperature control so that the temperature of the at least one of the rotating bodies reaches the higher temperature, the pair of rotating bodies are stopped, (a) a temperature obtained by deducting a constant temperature that is equal to or different from the constant temperature from the fixing temperature, is compared to (b) a predetermined temperature in the vicinity of the lower end of the transition temperature range that is equal to or different from the predetermined temperature, thus newly determining a higher temperature, and temperature control is performed so that the temperature of the at least one of the rotating bodies reaches the newly determined higher temperature.

16. The image formation method of claim 14, further comprising:

a detecting step of detecting a temperature of the at least one of the rotating bodies; wherein in the fixing control step, prior to performing temperature control to reach the standby temperature, the pair of rotating bodies is stopped when (a) the temperature, detected by the detector, of the at least one of the rotating bodies reaches a vicinity of the temperature obtained by deducting the constant temperature from the fixing temperature, or (b) without reaching the temperature obtained by deducting the constant temperature from the fixing temperature, either (i) a predetermined amount of time passes, or (ii) either one of the pair of rotating bodies has rotated a predetermined number of times.

17. The image formation method of claim 14, further comprising:

a detecting step of detecting a temperature of the at least one of the rotating bodies; wherein in the fixing control step, prior to performing temperature control to reach the standby temperature, the pair of rotating bodies is stopped when, after the temperature, detected by the detector, of the at least one of the rotating bodies reaches the standby temperature, (a) a predetermined amount of time passes, or (b) either one of the pair of rotating bodies has rotated a predetermined number of times.

18. The image formation method of claim 11, wherein in the fixing control step, (a) a temperature obtained by deducting a constant temperature from the fixing temperature is compared to (b) a predetermined temperature that is in a vicinity of, and is higher than a temperature that results in an error as an abnormally low temperature, thus determining a higher temperature that is a higher one of the two compared temperatures, and temperature control is performed so that the temperature of the at least one of the rotating bodies reaches the higher temperature determined as a result of the comparison.

19. The image formation method of claim 18, wherein in the fixing control step, prior to performing temperature control to reach the standby temperature, the pair of rotating bodies are caused to rotate, and after performing temperature control so that the temperature of the at least one of the rotating bodies reaches the higher temperature, the pair of rotating bodies are stopped, and (a) a temperature obtained by deducting a constant temperature that is equal to or different from the constant temperature from the fixing temperature, is compared to (b) a predetermined temperature that is equal to or different from the predetermined temperature, and that is in a vicinity of, and is higher than a temperature that results in an error as an abnormally low temperature, thus newly determining a higher temperature, and temperature control is performed so that the temperature of the at least one of the rotating bodies reaches the newly determined higher temperature.

20. The image formation method of claim 11, wherein the standby temperature is in a vicinity of an upper limit of a highest temperature that is permissible as a fixing temperature.

* * * * *